US008998733B2

(12) United States Patent
Kim

(10) Patent No.: US 8,998,733 B2
(45) Date of Patent: Apr. 7, 2015

(54) METHOD AND APPARATUS FOR MANUFACTURING NAILS

(75) Inventor: Chi Hyun Kim, Daegu (KR)

(73) Assignee: Zeus Techno Inc, Daegu (KR)

( * ) Notice: Subject to any disclaimer, the term of this patent is extended or adjusted under 35 U.S.C. 154(b) by 994 days.

(21) Appl. No.: 13/092,246

(22) Filed: Apr. 22, 2011

(65) Prior Publication Data

US 2012/0270667 A1 Oct. 25, 2012

(51) Int. Cl.

| | |
|---|---|
| ***B21G 3/00*** | (2006.01) |
| ***B21G 3/12*** | (2006.01) |
| ***B21G 3/20*** | (2006.01) |
| ***B21G 3/32*** | (2006.01) |

(52) U.S. Cl.
CPC .. *B21G 3/12* (2013.01); *B21G 3/20* (2013.01); *B21G 3/32* (2013.01)

(58) Field of Classification Search
CPC ..... B21G 3/12; B21G 3/20; B21G 3/32
USPC ..... 470/27, 34, 40, 110, 121, 123, 129, 470/139, 140, 179
See application file for complete search history.

(56) References Cited

U.S. PATENT DOCUMENTS

| | | | | |
|---|---|---|---|---|
| 4,020,515 | A * | 5/1977 | Goerke et al. | 470/164 |
| 4,918,809 | A | 4/1990 | Steinhilber | |
| 5,020,353 | A | 6/1991 | Christiansen | |
| 5,542,886 | A | 8/1996 | Scott et al. | |
| 5,626,522 | A | 5/1997 | Nielsen | |
| 6,508,715 | B1 | 1/2003 | Jensen | |
| 6,520,860 | B1 | 2/2003 | Jensen | |

* cited by examiner

*Primary Examiner* — Teresa M Ekiert
(74) *Attorney, Agent, or Firm* — Sand & Sebolt

(57) ABSTRACT

A nail-forming apparatus and method to rapidly form nails typically with circular heads is provided. One aspect relates to a sequential wire piece positioner configured for sequentially positioning wire pieces respectively adjacent a plurality of nail head formers. The wire piece positioner may include several carriages related to moving and forming the wire pieces.

20 Claims, 15 Drawing Sheets

METHOD AND APPARATUS FOR MANUFACTURING NAILS

BACKGROUND OF THE INVENTION

1. Technical Field

The present invention is related generally to an apparatus and method for manufacturing nails. More particularly, the invention relates to such an apparatus and method which forms the nails in a relatively rapid manner, especially nails with circular heads which are centered relative to the shaft of the nail.

2. Background Information

Amongst the various nail forming machines which have been used over the years, there are those which form nails having heads which are circular and those which form nails having heads which are non-circular. Generally, the nails with the circular heads are formed so that the circular outer perimeter of the head is concentric with the circular or cylindrical outer surface of the shaft of the nail whereas the nails having non-circular heads have heads which are generally oval shaped and which are offset more to one side of the nail shaft. With respect to nail forming machines currently available, those which form the nails with circular heads typically have a slower production rate than those which form nails with non-circular heads. The machines which form nails with circular heads typically have a wire feeder and cutter which feeds a wire piece between a pair of jaws which clamp a wire piece therebetween while a punch assembly punches one end of the nail to deform that end into the circular head, after which the jaws move apart from one another to allow the newly formed nail to be ejected therefrom. The wire feeder and cutter then feed another wire piece between the jaws to be clamped and punched.

One of the types of machines which is used to form nails with non-circular heads utilizes a pair of flat rotating clamping wheels which generally overlap one another so that their flat sides are angled somewhat relative to one another and which respectively carry multiple jaws adjacent the outer perimeters thereof having formed therein wire piece carrying grooves each of which is perpendicular to and lies along a respective radius of the rotational axis of the given clamping wheel. Because these clamping wheels and their axes of rotation are angled relative to one another, the outer perimeters thereof and the corresponding jaws are adjacent one another adjacent a head forming position and somewhat spaced apart from one another on the opposite side of the wheels. The feeding and cutting assembly thus feeds wire pieces between jaws when they are relatively adjacent one another so that the jaws carry the wire pieces to the head forming position, where the nail heads are formed by a swaging roller which is rotatably mounted and has a circular outer perimeter adjacent the outer perimeters of the clamping wheels. Thus, the outer perimeter of the swaging roller sequentially rolls along the ends of the wire pieces to form the non-circular heads thereon as each wire piece moves through the head forming position.

Given the types of machines described above, there is a need in the art for a nail forming machine which is configured to rapidly produce nails having circular heads. The present invention provides such a machine and method while addressing various concerns in the art.

BRIEF SUMMARY OF THE INVENTION

The present invention provides a nail-forming apparatus comprising: a first carriage; a plurality of nail head formers mounted on the carriage; and a sequential wire piece positioner configured for sequentially positioning wire pieces respectively adjacent the nail head formers.

The present invention also provides a nail-forming apparatus comprising: a first rotatable member which is rotatable about a first axis; a plurality of circumferentially spaced wire piece-engaging first surfaces which rotate with the first rotatable member along a first circular path; a second rotatable member which is rotatable about a second axis; a plurality of circumferentially spaced wire piece-engaging second surfaces which rotate with the second rotatable member along a second circular path; a nail head forming position adjacent the first and second circular paths; and a plurality of nail head formers which are carried by the second rotatable member respectively adjacent the second surfaces.

The present invention further provides a nail-forming apparatus comprising: a first carriage; a plurality of nail head formers which are mounted on the first carriage and which are adapted for deforming an end of a wire piece to form a nail head from the end of the wire piece; and a plurality of spaced magnets which are positionable respectively adjacent the nail head formers and which are adapted to magnetically carry respective wire pieces.

BRIEF DESCRIPTION OF THE SEVERAL VIEWS OF THE DRAWINGS

A preferred embodiment of the invention, illustrated of the best mode in which Applicant contemplates applying the principles, is set forth in the following description and is shown in the drawings and is particularly and distinctly pointed out and set forth in the appended claims.

FIG. 13 shows these components immediately prior to the movement of a wire piece into a groove of the right jaw drum which is adjacent and approaching the head forming position whereby the associated punch of the head former is in the non-punching position just prior to the punching operation.

FIG. 16 also illustrates that the next sequential head forming or punching assembly is moving toward the head forming position as the other cam lobe of the cam is moving toward its engaging position in which it will engage the wheel of the next punching assembly to move it to its punching position for forming the head on the next wire piece to form another nail.

Similar numbers refer to similar parts throughout the drawings.

DETAILED DESCRIPTION OF THE INVENTION

Figure 1:
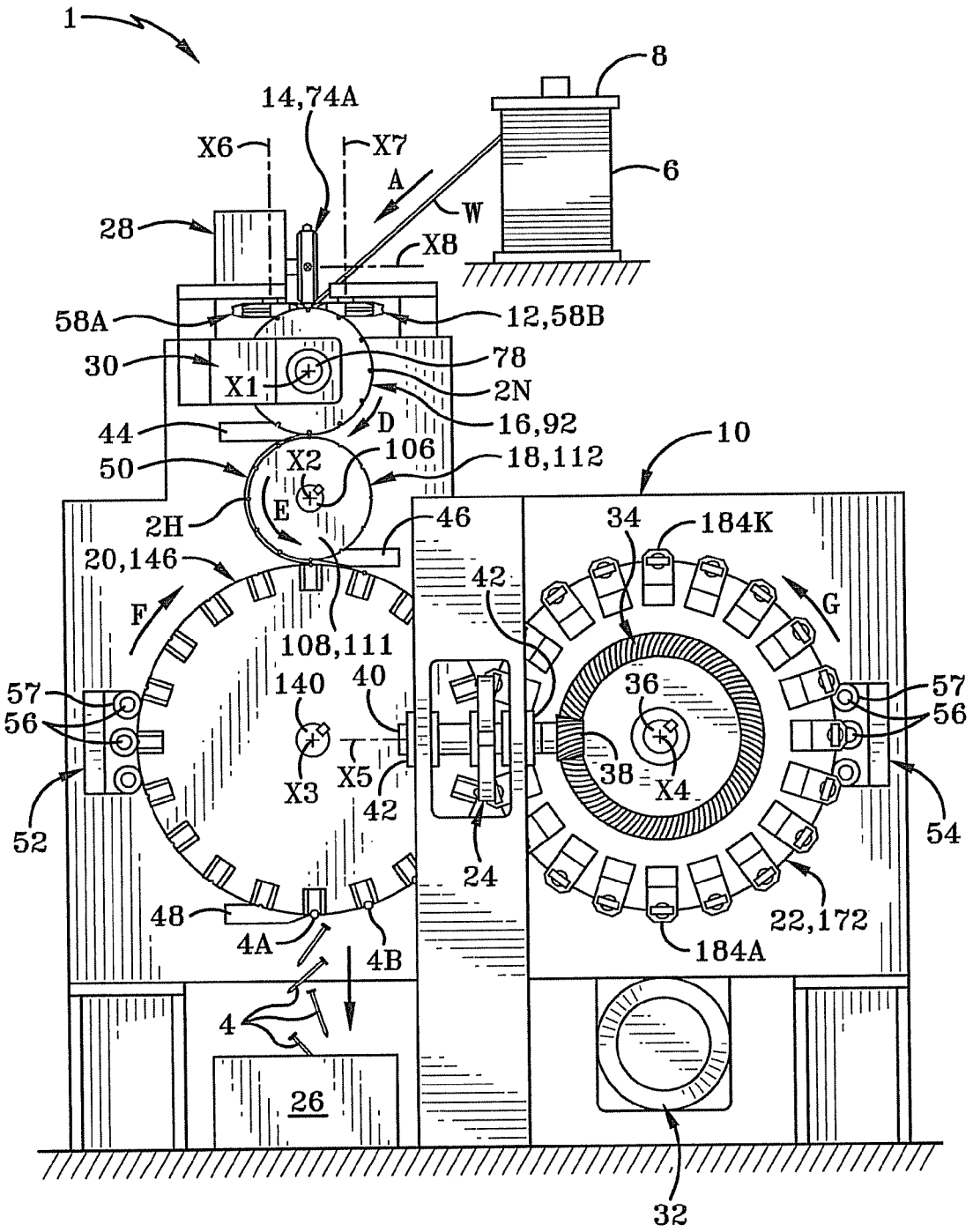
FIG. 1 is a front elevational view of the nail forming machine of the present invention with some aspects shown diagrammatically.

The nail forming apparatus or machine of the present invention is shown generally at 1 in FIG. 1. Machine 1 is configured for cutting metal wire W into metal wire pieces 2 which are further formed into nails 4. The malleable wire pieces are more particularly denoted at 2A-2Q, and some of the nails are denoted at 4A-4F, as illustrated primarily in FIGS. 2-5. Each wire piece 2 has a head or first end 3 (FIG. 2) and an opposed tip or second end 5. Machine 1 includes a synchronized drive assembly for moving various parts in a synchronized manner to properly feed the wire pieces 2 through the machine in a sequential manner, that is, one wire piece after the other in sequence. In the exemplary embodiment, the synchronized drive assembly includes several drive assemblies, three of which will be mentioned in greater detail further below.

The synchronized drive assembly drives the movement of the various components of a sequential wire piece positioner which is configured to sequentially position wire pieces 2 in specific locations as wire pieces 2 move downstream through machine 1. A source of wire typically in the form of a roll 6 is wound on a spool 8 and unwinds therefrom as the wire moves downstream through machine 1. Machine 1 includes a rigid frame 10 which is typically formed primarily of metal and on which are mounted the various moving components of the sequential wire piece positioner. The positioner includes a wire feeder 12, a wire cutter 14 adjacent and downstream of feeder 12, a first or upper rigid wire transmitter 16 adjacent and downstream of cutter 14, a second or lower rigid wire transmitter 18 adjacent and downstream of transmitter 16, a first or left rigid jaw drum adjacent and downstream of second transmitter 18, and a second or right rigid jaw drum 22 which is adjacent drum 20 and downstream of second transmitter 18. Each of transmitters 16 and 18 and drums 20 and 22 may also be referred to as rotatable members, carriages, wheels, disks or the like. Carriages 16, 18, 20 and 22 rotate about respective parallel horizontal axes X1, X2, X3 and X4. In the exemplary embodiment, axis X2 is directly below axis X1 while axis X3 is directly, below axes X1 and X2 whereby axes X1, X2 and X3 typically lie in a common vertical plane. In the exemplary embodiment, axis X4 is directly to the right of and substantially at the same height of axis X3. A cam 24 is rotatably mounted directly in front of a nail head forming position at which heads are formed on wire pieces 2 to form nails 4. A nail-receiving bin 26 or nail-collecting or storage location is positioned downstream of first drum 20 to receive nails 4 as they are ejected or stripped from drum 20.

The synchronized drive assembly includes a continuous drive assembly 28 which typically includes an electric motor and various gears which are operably connected to and driven by the motor whereby the motor and gears are operably connected to feeder 12 and cutter 14 to drive operation thereof and more particularly to drive rotation of the various wheels thereof as discussed further below. The synchronized drive assembly also includes an intermittent transmitter drive assembly 30 which is configured to intermittently drive rotation of first transmitter 16. Drive assembly 30 typically includes an electric motor with a rotatable driveshaft, various gears and an intermittent drive, such as a Geneva drive configured to translate continuous rotational movement of the driveshaft of the motor into intermittent rotation of transmitter 16. Although a Geneva drive works well for this application, other types of intermittent drive assemblies may be used. The synchronized drive assembly further includes another continuous drive assembly 32 typically including an electric motor with a rotatable driveshaft and gears operably connected thereto which are operably connected to jaw drums 20 and 22 in order to drive rotation of drums 20 and 22.

A gear disk or gear 34 is rigidly secured to a rigid driveshaft 36 to which jaw drum 22 is also rigidly secured such that gear disk 34, shaft 36 and drum 22 rotate together as a unit about axis X4. Gear 34 engages a smaller gear or pinion 38 rigidly secured to the end of a horizontal shaft 40 which is perpendicular to horizontal shaft 36 and spaced directly forward of the left portion of drum 22 and the right portion of drum 20. Shaft 40 is rotatably mounted on frame 10 by a pair of bearings 42 on opposed sides of cam 24. Cam 24 is rigidly secured to and extends radially outwardly from shaft 40 so that cam 24, shaft 40 and pinion 38 rotate together as a unit. Thus, drive assembly 32 not only drives rotation of jaws 20 and 22 through various gears, but also drives rotation of shaft 36, gear 34, pinion 38, shaft 40 and cam 24 partially through the engagement between gears 34 and 38. Pinion 38, shaft 40 and cam 24 rotate about a horizontal axis X5 which extends from the left to the right and is perpendicular to axes X1-X4.

A first ejector 44 or stripping device is located adjacent and directly between the respective outer perimeters of transmitters 16 and 18. More particularly, ejector 44 is positioned adjacent the bottom of transmitter 16 and the top of transmitter 18. A second ejector 46 or stripping device is positioned adjacent and directly between the outer perimeters of transmitter 18 and jaw drum 20, more particularly adjacent the bottom of transmitter 18 and the top of drum 20. A third ejector 48 or stripping device is positioned adjacent the outer perimeter of jaw drum 20 and more particularly adjacent the bottom thereof. Each of ejectors 44, 46 and 48 is rigidly secured to frame 10 and thus is fixed relative thereto and stationary during operation of machine 1 although the ejectors may be removed and replaced if necessary. A rigid retaining or holding member in the form of an arcuate plate 50 is rigidly secured to frame 10 directly to the left of and adjacent the outer perimeter of transmitter 18 such that plate 50 is fixed relative to frame 10 and substantially stationary during operation of machine 1.

A first or left support roller assembly 52 is secured to frame 10 adjacent and to the left of jaw drum 20. Likewise, a second or right support roller assembly 54 is secured to frame 10 adjacent and to the right of jaw drum 22. Each of the assemblies 52 and 54 includes rotatable rollers 56 having circular outer perimeters 57 which engage the circular outer perimeters of the corresponding drum 20 and 22. More particularly, the rollers 56 of assembly 52 engage the outer perimeter of drum 20 opposite the head forming location and cam 24 while the rollers 56 of assembly 54 engage the outer perimeter of drum 22 at a location opposite the head forming location and cam 24. Thus, the head forming location and cam 24 are positioned substantially midway between assemblies 52 and 54.

Figure 2:
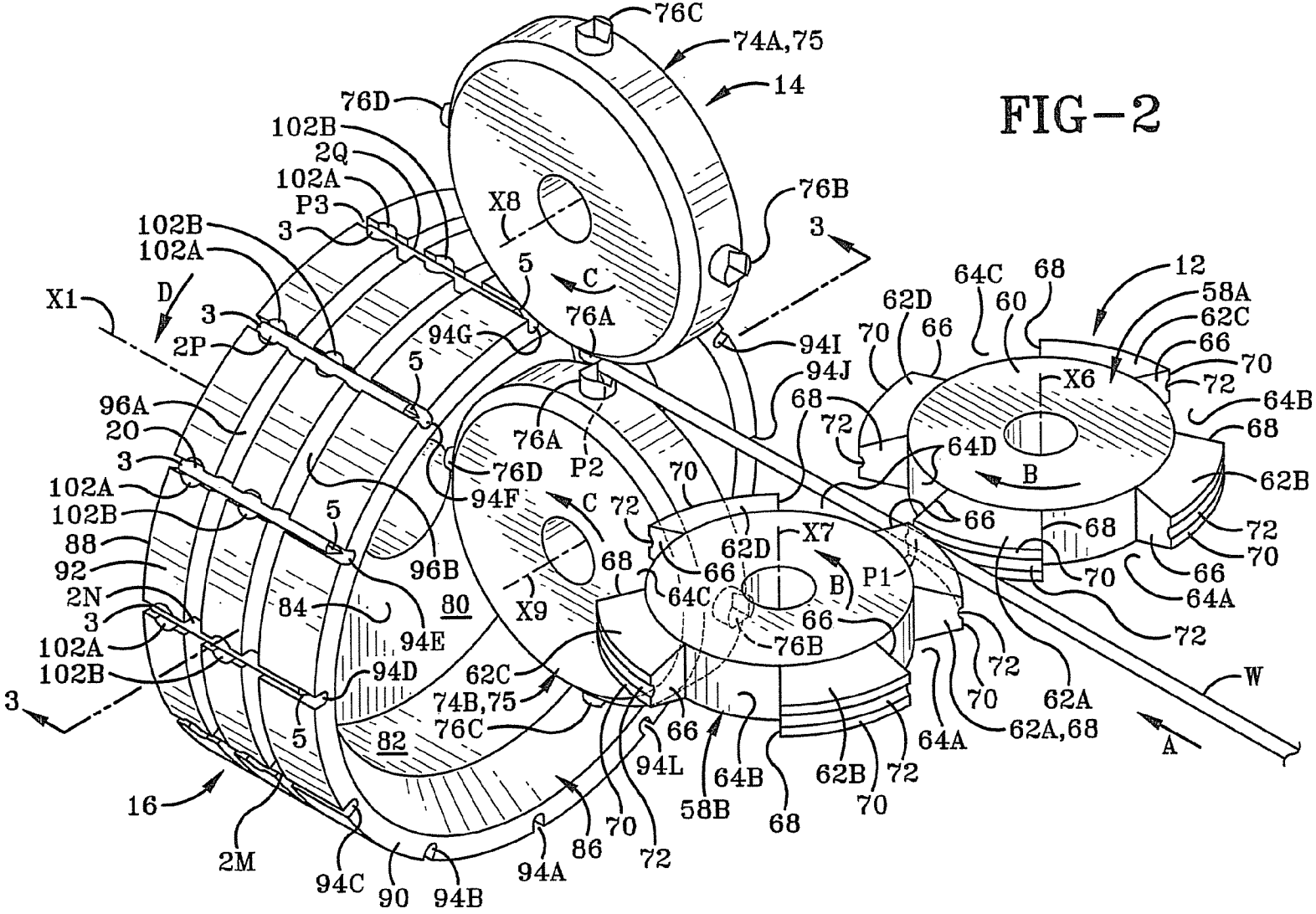
FIG. 2 is an enlarged perspective view from the right side, from the rear and from above of the wire feeder, wire cutter and first wire piece transmitter.

With primary reference to FIG. 2, wire feeder 12 is described in greater detail. Feeder 12 includes a first or left rigid rotatable member or feeder wheel 58A and a second or right rigid rotatable member or feeder wheel 58B which is substantially identical to wheel 58A. Wheels 58A and B are respectively rotatable about horizontally offset vertical axes X6 and X7, which are thus perpendicular to the various horizontal axes noted herein. Each wheel 58 has a rigid cylindrical hub 60 and four substantially identical circumferentially spaced rigid wire feed arms 62A-D which are rigidly secured to and extend radially outwardly from the perimeter of hub 60 away from axis X6. Wire feed arms 62 define therebetween substantially identical non-feeding blank areas, voids or open spaces 64A-D. Each arm 62 has radially extending leading and trailing ends 66 and 68 and an arcuate outer surface 70 which extends circumferentially from the respective leading end 66 to the respective trailing end 68. Each arcuate outer surface 70 is an arc of a circle which is concentric about either axis X6 (for wheel 58A) or axis X7 (for wheel 58B). Thus, the outer surfaces 70 define a respective circular outer perimeter of the given wheel 58 as well as a circular path along which the respective arcs 70 travel during rotation.

Arcuate circumferentially extending grooves 72 are formed respectively in each arm 62 extending radially inwardly from outer surface 72. The grooves 72 of a given wheel 58 are arcs of a circle concentric about the corresponding axis X6 or X7 and thus lie along a common circular path concentric about the respective axis. Each groove 72 extends from the leading end 66 to the trailing end 68 of a given arm 62. Each of the blank areas or voids 64 extends circumferentially from the trailing end 68 of one arm 62 to the leading end 66 of the next or adjacent arm 62 of a given wheel 58. Thus, for example, space 64A extends from the trailing end 68 of arm 62A of a given wheel to the leading end 66 of arm 62B of a given wheel 58. The circumferential length of each groove 72 or the surface defining each groove 72, as measured from the leading end 66 to the trailing end 68 of the given arm 62 is substantially the same as the length of each wire piece 2 measured from end 3 to end 5.

During the synchronized rotation of wheels 58A and B, the outer surfaces 70 and grooves 72 move closely adjacent and pass by a wire engaging position P1 disposed directly between wheels 58A and B and their respective axes X6 and X7. The surfaces defining grooves 72 are thus wire engaging surfaces which may also be denoted at 72 and which engage wire W during operation in order to feed the wire toward wire cutter 14. As surfaces 70 of analogous arms 62 of wheels 58A and B move past position P1, said surfaces 70 are closely adjacent or in contact with one another, while the corresponding grooves 72 are closely adjacent one another as well. For example, the surfaces 70 and grooves 72 of analogous arms 62A of wheels 58A and 58B are closely adjacent one another and are synchronized to move so that leading ends of 66 thereof reach position P1 or a location immediately adjacent thereto at the same time, and so that the trailing ends of 68 of arms 62A likewise subsequently reach the position P1 or a location immediately adjacent thereto at the same time. It is likewise true of the surfaces 70 and the grooves 72 of the corresponding arms 62B, as well as those of arms 62C and of arms 62D, which sequentially and repeatedly move past position P1 during rotation of wheels 58.

With continued primary reference to FIG. 2, wire cutter 14 is described in greater detail. Wire cutter 14 includes a first or upper rotatable member or cutter wheel 74A and a second or lower rotatable member or cutter wheel 74B. Wheels 74 are rigid structures and are respectively rotatable about vertically offset horizontal axes X8 and X9 which are perpendicular to the horizontal axes X1-X4 and parallel to axis X5. Each cutter wheel 74 is a rigid structure that includes a rigid cylindrical hub, body or disk 75 with four cutting tips 76A-D extending radially outwardly from the circular outer perimeter of the hub 75 away from the corresponding axis X8 or X9. Cutting tips 76 are hardened tips which are configured to cut wire W to form wire pieces 2 while simultaneously forming the head end 3 and sharpened tip end 5 of the wire piece 2 which subsequently serves as the tip of the nail 4. In the exemplary embodiment, tips 76A-D are circumferentially spaced at about 90 degrees from one another such that for a given wheel 74, tip 76A is directly opposite tip 76C and tip 76B is directly opposite 76D. The tips 76A-D of wheel 74A rotate along a common circular path which is concentric about axis X8 while the cutting tips 76A-D of cutter wheel 74B likewise lie along and rotate along a circular path which is concentric about axis X9 so that these two circular paths are substantially coplanar and adjacent one another. The synchronized drive assembly thus rotates wheels 74A and B in a manner that the corresponding cutting tips 76A are synchronized to move past a cutting position P2 directly between the outer perimeters of bodies 75 and directly between axes X8 and X9 simultaneously in order to cut wire W at position P2. During the synchronized rotation of wheels 74, the corresponding cutting tips 76B thus simultaneously move closely adjacent to cutting position P2 sequentially after cutting tips 76A. Likewise, cutting tips 76C sequentially follow cutting tips 76B to position P2, with cutting tips 76D sequentially following tips 76C to position P2 so that the continuous rotation of wheels 74 repeatedly moves tips 76A-D past position P2 repeatedly in a sequential manner.

Figure 3:
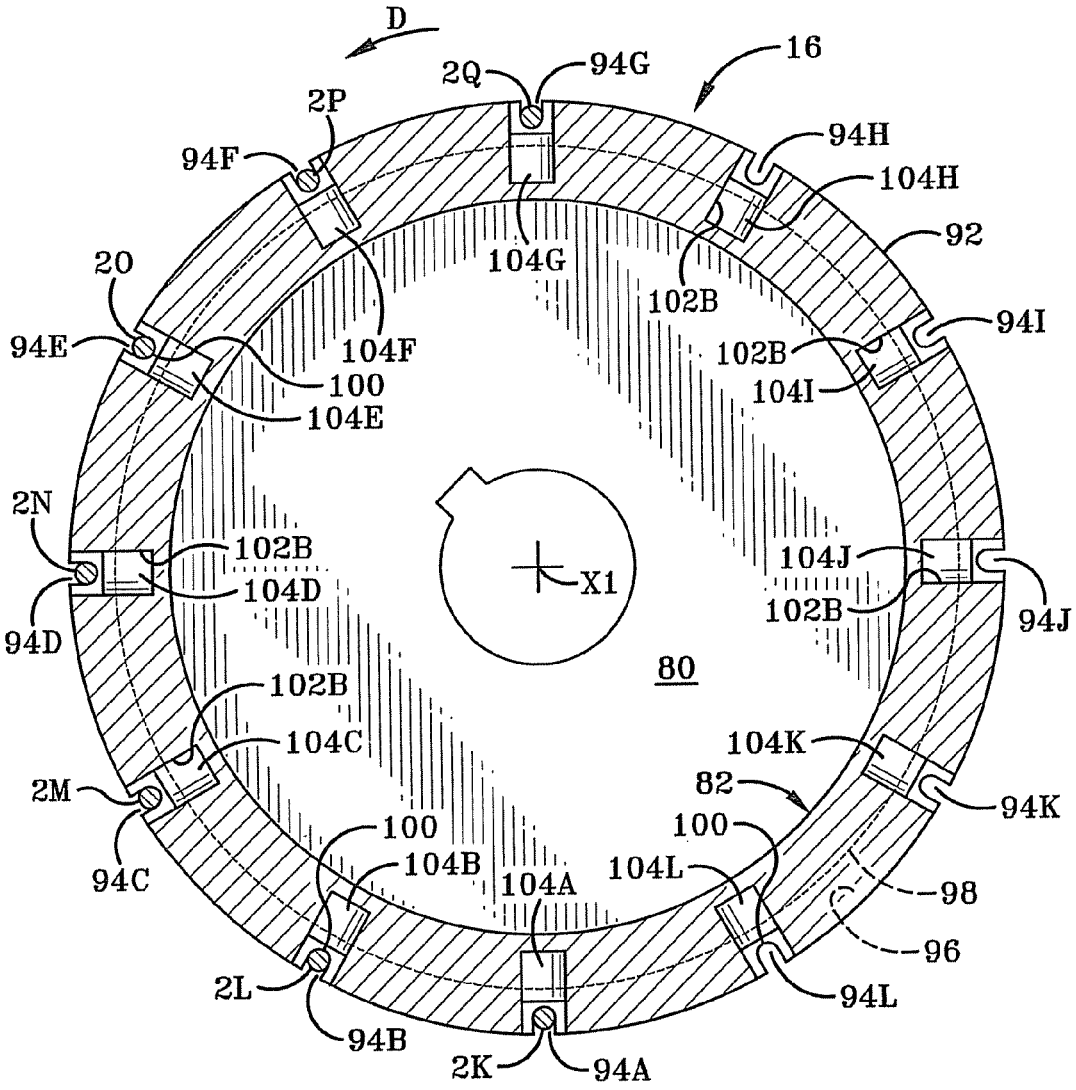
FIG. 3 is a sectional view taken on line 3-3 of FIG. 2 showing the magnets and other aspects of the first wire piece transmitter.

With primary reference to FIGS. 2 and 3, first wire transmitter 16 is described in greater detail. Transmitter 16 is a rigid structure which is rotatably mounted about axis X1 via an axle 78 (FIG. 1) mounted on frame 10. Carriage or transmitter 16 includes a rigid disk-shaped hub 80 which extends radially outwardly from axle 78 to a circular outer perimeter. Transmitter 16 further includes a cylindrical side wall 82 rigidly secured to the outer perimeter of hub 80 and extending rearwardly and outwardly therefrom whereby the hub and side wall define there within a cavity or interior chamber 84 having a rear entrance opening 86. More particularly, cavity 84 is defined by a rear surface of hub 80 and a circular or cylindrical inner surface of side wall 82. Side wall 82 has a circular forward facing front or front side 88 and an opposed rearward facing back or back side 90 which defines opening 86. Side wall 82 also has a circular or cylindrical outer perimeter 92 which is concentric about and faces radially outwardly away from axis X1 and extends from front surface 88 to back surface 90.

Figure 4:
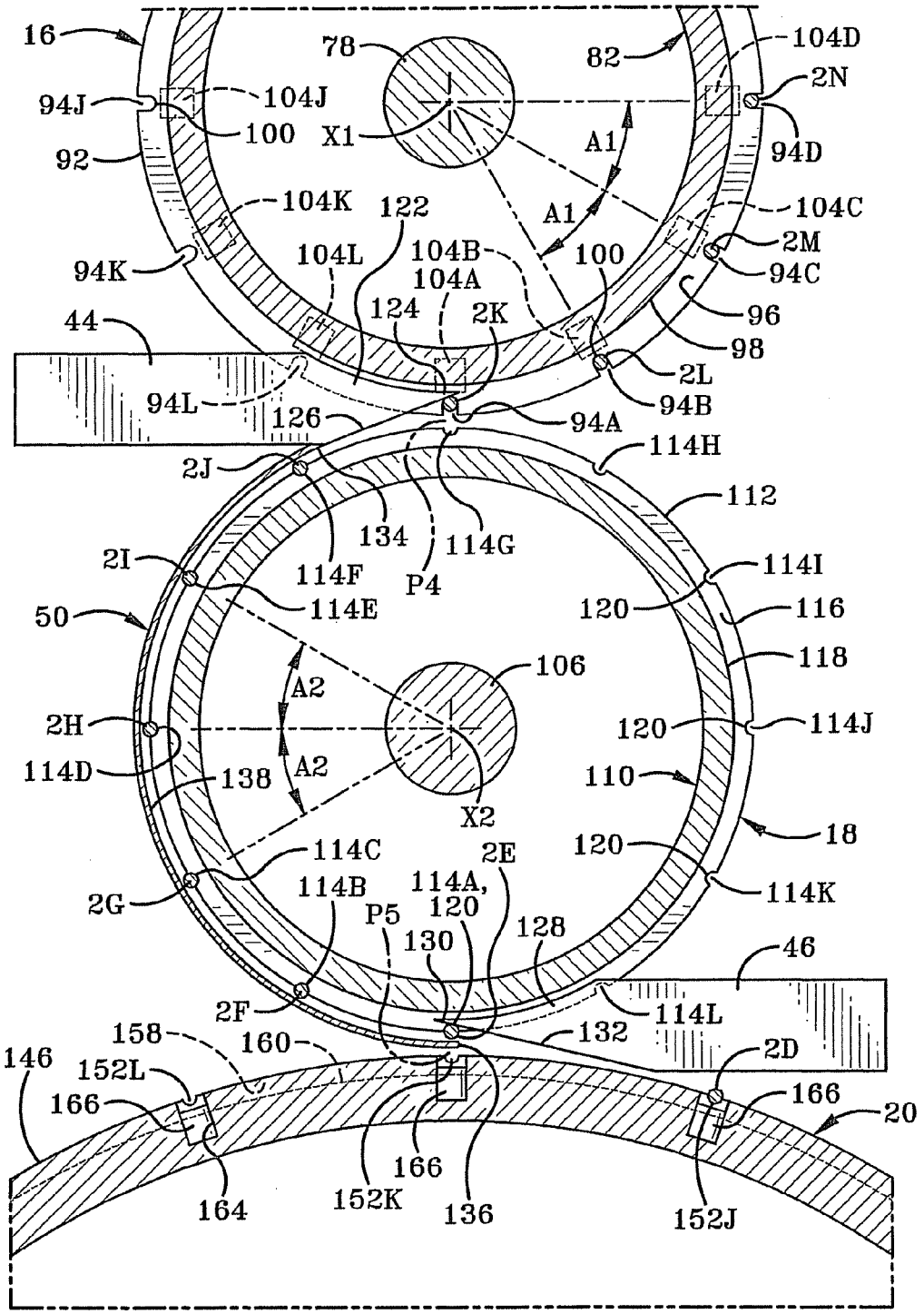
FIG. 4 is an enlarged sectional view from the front through the second wire piece transmitter, the lower portion of the first wire piece transmitter and an upper portion of the left jaw drum adjacent the second wire piece transmitter.

A plurality (twelve in the exemplary embodiment) of straight wire piece receiving grooves 94 are formed in side wall 82 extending radially inwardly from outer perimeter 92. Grooves 94 are parallel to axis X1 and thus perpendicular to each of axes X5-X9. Grooves 94 are circumferentially spaced from one another so that each adjacent pair of grooves is the same distance from one another as any other adjacent pair of grooves 94. FIG. 4 illustrates that the circumferential widths or angles A1 defined between each adjacent pair of groove 94 are equal. Each groove 94 extends continuously from front 88 to back 90 and thus communicates with front and back 88 and 90. The surfaces defining grooves 94 respectively serve as wire piece engaging surfaces which may also be denoted at 94 and which engage the given wire piece 2 when received within the respective groove 94. Each groove 94 is relatively shallow whereby the entire groove 94 is adjacent outer perimeter 92. Front 88 serves as the front or front end of each groove 94 whereas back 90 serves as the rear or rear end of each groove 94.

Grooves 94 are more particularly denoted in sequential order as grooves 94A-L. During rotation of transmitter 16, grooves 94A-L thus move sequentially along a circular path (defined by or adjacent outer perimeter 92) concentric about axis X1 and, for instance, move sequentially into a wire piece receiving position P3 at the top of transmitter 16, which is where groove 94G is in FIG. 2. The groove at position P3 is adjacent and substantially directly in front of position P2 and the corresponding cutting tips 76 as they pass adjacent position P2. Position P2 is typically slightly higher than the groove 94 at position P3. It is also noted that tips 76 and portions of body 75 of lower cutter wheel 74B may be disposed in interior chamber 84 of transmitter 16 via entrance opening 86. Body 75 of upper wheel 74A is typically higher than the top of outer perimeter 92 whereas the body 75 of lower wheel 74B is typically lower than the top of outer perimeter 92. Cutting tips 76 of each of cutter wheels 74 when in their forward most position may be forward of rear surface 90 of transmitter 16.

First or forward and second or rearward circular ejector receiving grooves 96A and 96B are also formed in side wall 82 extending radially inwardly from outer perimeter 92. Grooves 96A and B are concentric about axis X1 and are deeper than grooves 94. Thus, each ejector groove 96 has a circular bottom 98 (FIG. 3) which is deeper or further inwardly from outer perimeter 92 than is a bottom 100 of the each groove 94. Bottom 98 is thus closer to axis X1 than are each of bottoms 100 of grooves 94. Each of grooves 96 communicates with or intersects each groove 94 in a perpendicular fashion. Thus, a short segment of each wire piece 2 is disposed in and respectively intersects grooves 96 when the wire piece 2 is disposed in one of wire receiving grooves 94. Front and rear magnet mounting or magnet receiving holes 102A and 102B are also formed in side wall 82 extending inwardly from outer perimeter 92 and in communication respectively with grooves 94. Thus, holes 102A serve as forward magnet mounting holes which are between front 88 and front groove 96A whereas each hole 102B serves as a rearward magnet mounting hole disposed between forward and rearward ejector grooves 96A and 96B. Holes 102A are circumferentially equally spaced from one another and receive magnets 104 therein which are likewise circumferentially equally spaced from one another. Similarly, holes 102B are circumferentially equally spaced from one another and receive therein magnets 104 which are likewise circumferentially equally spaced from one another. Magnets 104 are more particularly denoted in sequential order as magnets 104A-104L whereby magnets 104A-L are respectively adjacent grooves 94A-L. Magnets 104 pass sequentially and repeatedly adjacent position P3 during rotation of carriage 16. The radial outward end of each magnet 104 is generally adjacent the bottom 100 of the corresponding groove 94 whereby the given magnet 104 is configured to magnetically attract a corresponding wire piece 2 within the given groove 94 and thereby serves as a retaining member which retains the magnetically attractable wire piece 2 within the groove at a given time as transmitter 16 carries the given wire piece from adjacent cutter 14 to transfer to transmitter 18.

Carriage or transmitter 18 is now described in greater detail with primary reference to FIG. 4. Transmitter 18 is mounted on a shaft or axle 106 through which axis X2 passes centrally. Transmitter 18 includes a rigid hub 108 (FIG. 1) and a rigid generally cylindrical side wall 110 rigidly secured to and extending axially outwardly from hub 108. Side wall 110 has a circular or cylindrical outer perimeter 112 which is concentric about axis X2, which defines an outer diameter of transmitter 18 which is substantially the same as that of transmitter 16, and which defines a circular path along which the outer perimeter travels during rotation. Outer perimeter 112 extends from a front surface 111 of transmitter 18 to a back surface thereof. Generally, transmitter 18 is very similar in structure to transmitter 16 except that transmitter 18 does not carry a magnet or magnets for magnetically attracting wire pieces 2.

Like transmitter 16, there are straight wire piece receiving grooves 114A-L (twelve in the exemplary embodiment) formed in side wall 110 of transmitter 18 and extending inwardly from outer perimeter 112 a short distance such that each groove 114 is entirely adjacent outer perimeter 112. Each groove 114 extends from front surface 111 to the back surface of sidewall 110. Grooves 114 lie on and travel along a common circular path concentric about axis X2 on or adjacent perimeter 112. Grooves 114 are parallel to axis X2, are circumferentially equally spaced from one another and are substantially semicircular in section as viewed parallel to axis X2. FIG. 4 shows the equal circumferential widths or angles A2 between each adjacent pair of grooves 114. The surface defining each groove 114 serves as a wire piece engaging surface which may also be denoted at 114. A pair of circular ejector grooves 116 (only one shown) are formed in side wall 110 extending radially inwardly from outer perimeter 112 in the same manner as grooves 96 of transmitter 16. Grooves 116 are deeper than grooves 114 such that each groove 116 has a bottom 118 which is further from outer perimeter 112 and closer to axis X2 than is a bottom 120 of each groove 114.

In the exemplary embodiment, transmitter 18 is positioned directly below transmitter 16 so that together, outer perimeters 92 and 112 form a figure 8-shaped configuration as viewed from the front or generally parallel to axes X1 and X2. During the rotation of transmitters 16 and 18, outer perimeters 92 and 112 are closest to one another adjacent a position P4 which in the exemplary embodiment is directly above the top of outer perimeter 112 and directly below the bottom of outer perimeter 92 and directly between axes X1 and X2. Outer perimeters 92 and 112 are closely adjacent one another adjacent position P4 but typically not in contact with one another. Respective tangents to outer perimeters 92 and 112 adjacent position P4 are thus horizontal and parallel to one another, that is, tangents at the bottom of outer perimeter 92 and at the top of outer perimeter 112. The upwardly facing portion of outer perimeter 112 of the top side of transmitter 18 faces the downwardly facing portion of outer perimeter 112 of the bottom side of transmitter 16 whereas the downwardly facing portion of outer perimeter 112 of the bottom side of transmitter 18 faces away from and is distal the upwardly facing portion of outer perimeter 92 of the top side of transmitter 16. Grooves 94, magnets 104 and grooves 114 pass sequentially and repeatedly adjacent position P4 during rotation of carriages 16 and 18.

With continued reference to FIG. 4, ejector 44 is shown as having a generally rectangular left portion and a generally triangular right portion such that the triangular section or portion includes an insert portion 122 which is disposed in grooves 96. The triangular portion has a tip portion 124 which is the rightmost portion of insert portion 122 and is positioned further from axis X1 than is bottom 98 of groove 96 and closer to axis X1 than is bottom 100 of each groove 94. The triangular portion of ejector 44 also has a generally downwardly facing cam surface 126 which angles downwardly and to the left relative to tip 124. Surface 126 thus angles downwardly and outwardly away from axis X1 from adjacent bottom 98 of groove 96 (and bottom 100 of a given groove 94 when at the bottom position adjacent position P4) to adjacent outer perimeter 112 of transmitter 18 and to adjacent upper end 134 of arcuate surface 138 of retaining member 50.

With continued reference to FIG. 4, ejector 46 is described in greater detail. Ejector 46 is substantially the same as ejector 44 except that it is positioned facing in the opposite direction and is generally adjacent the bottom of transmitter 18 and the top of jaw drum 20. Ejector 46 thus also has a generally rectangular right portion and a triangular left portion which is secured to the rectangular portion and extends to the left therefrom. The triangular portion has an upper insert portion 128 which is received within grooves 116 adjacent the bottom of transmitter 18 and includes a tip portion 130 which serves as the leftmost portion of the triangular portion and ejector 46. The triangular portion also has a cam surface 132 which angles downwardly and to the right generally from adjacent the bottom of outer perimeter 112 of transmitter 18 to adjacent the outer perimeter of jaw drum 20. Tip 130 and the portion of cam surface 132 defined by tip 130 is further from axis X2 than is bottom 118 of groove 116 and closer to axis X2 than is bottom 120 of each groove 114. Surface 132 extends downwardly and outwardly to the right away from axis X2 from within groove 116 to a position external to groove 116. Surface 132 also extends from adjacent the lower end of arcuate surface 138 outwardly and to the right therefrom. Surface 132 also angles downwardly and outwardly away from axis X2 from adjacent bottom 118 of groove 116 and bottom 120 of a given groove 114 when at the bottom position adjacent position P5 to adjacent the outer perimeter of carriage 20.

With reference to FIG. 4, holding member or plate 50 is described in greater detail. Plate 50 has a first or upper end 134 and a second or lower opposed end 136 with an arcuate substantially semicircular retaining surface 138 extending from adjacent upper end 134 to adjacent lower end 136. The entire length or nearly the entire length of surface 136 from adjacent end 134 to adjacent end 136 is concentric about axis X2 and adjacent outer perimeter 112 along its left side. Surface 138 thus extends from adjacent the top of outer perimeter 112 to adjacent the bottom of outer perimeter 112 only along the left side of transmitter 18. Retaining surface 138 is adjacent and spaced outwardly from outer perimeter 112 along its entire length so that the normal distance from the convex outer perimeter 112 and the concave inner retaining surface 138 is less than the diameter of each wire piece 2 so that a wire piece 2 cannot fit within the space defined between outer perimeter 112 and surface 138. Surface 138 is thus configured to hold or retain wire pieces 2 within respective grooves 114 as they are carried within grooves 114 from adjacent the bottom of transmitter 16 to adjacent the top of drum 20.

Figure 5:
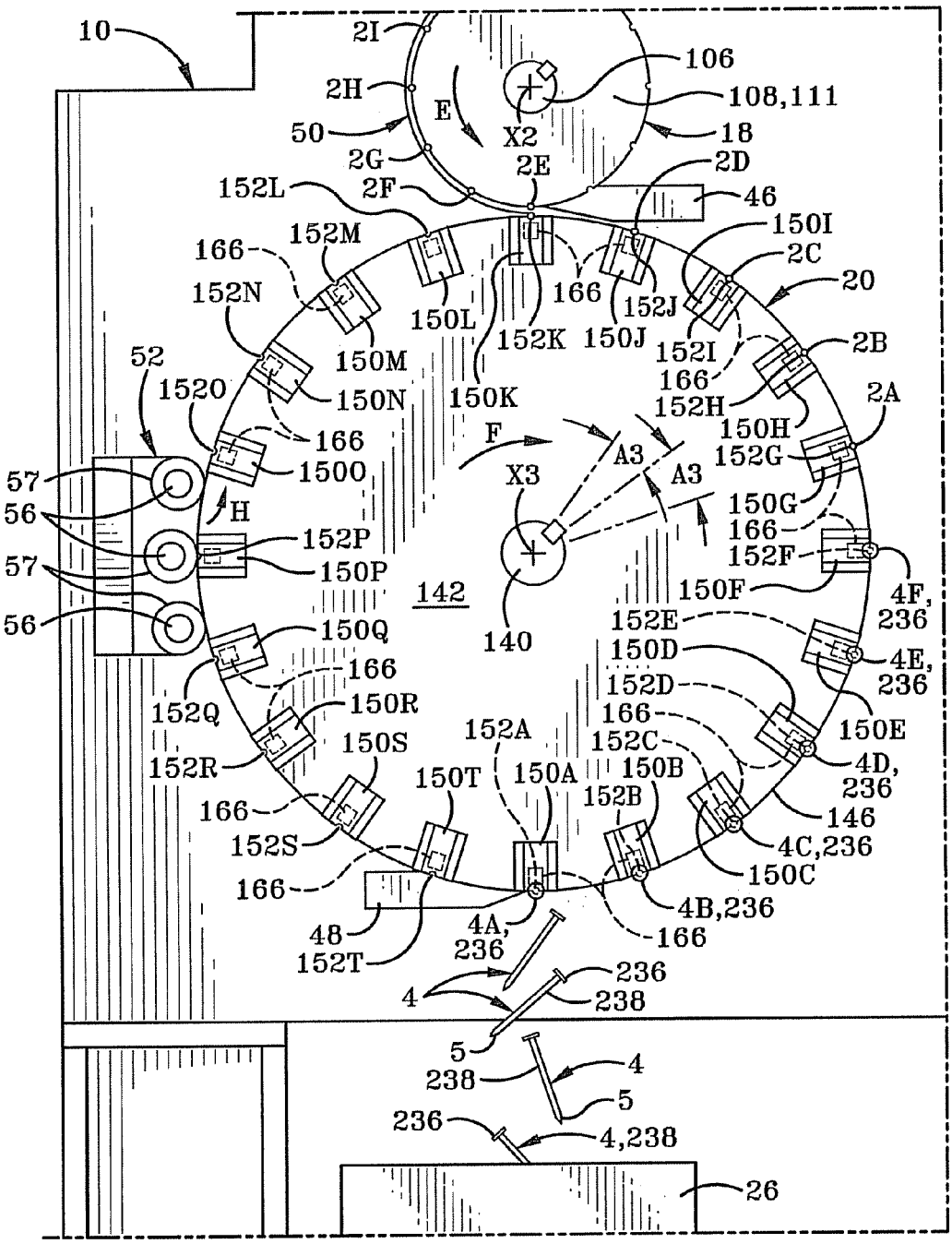
FIG. 5 is an enlarged front elevational view primarily of the left jaw drum.
Figure 7:
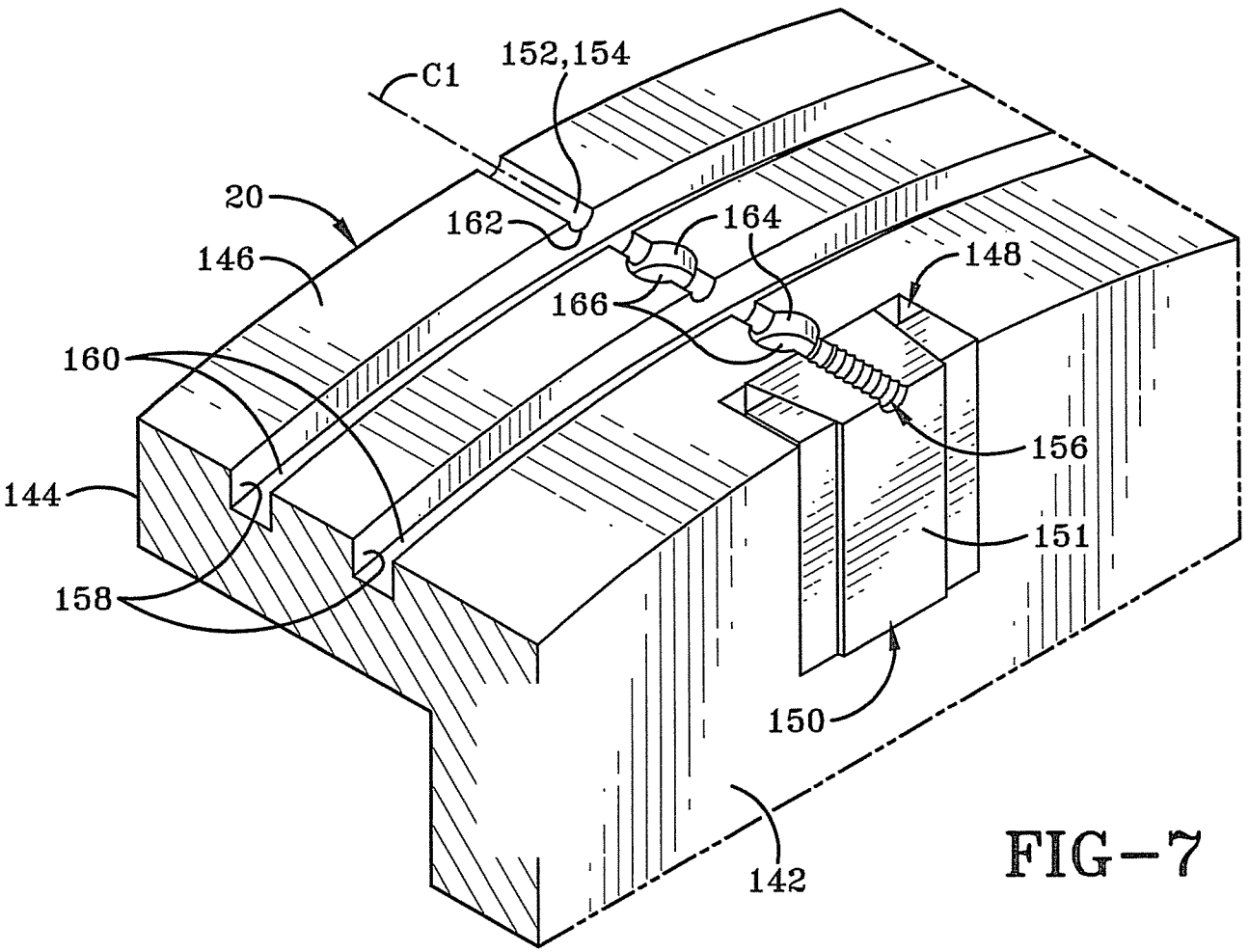
FIG. 7 is a perspective view with portions cut away and with portions in section showing a portion of the left jaw drum with one of the jaws, the corresponding wire piece receiving groove and magnets.

With primary reference to FIGS. 5 and 7, carriage or jaw drum 20 is now described in greater detail. Jaw drum 20 is mounted on and extends radially outwardly from an axle or shaft 140 which has central axis X3. Jaw drum 20 has a front or front surface 142 and a back or back surface 144 and a circular or cylindrical outer perimeter 146 which extends from the front 142 to the back 144 and is concentric about axis X3. Perimeter 146 thus defines a circular path concentric about axis X3 along which perimeter 146 travels during rotation. Multiple circumferentially spaced jaw receiving recesses 148 are formed in drum 20 extending radially inwardly from outer perimeter 146 and rearwardly from front surface 142. Recesses 148 are circumferentially equally spaced from one another and carry therein respective jaws 150A-T which are likewise circumferentially equally spaced from one another and have respective flat vertical front surfaces 151. Each of the rigid jaws 150 is rigidly and securely mounted within the respective recess 148 on the body of drum 20. Jaws 150 are typically formed of a hardened metal which is harder than the metal of which the body of drum 20 is formed.

A plurality (twenty in the exemplary embodiment) of straight wire piece receiving grooves 152A-T are formed in the cylindrical side wall of drum 20 extending inwardly from outer perimeter 146 a short distance such that each groove 152 is in its entirety adjacent outer perimeter 146. Grooves 152 are parallel to axes X1-X4, to one another and to grooves 94 of transmitter 16 and grooves 114 of transmitter 18. The surface defining each groove 152 serves as a wire piece engaging surface which may also be denoted at 152. FIG. 5 shows that each adjacent pair of grooves 152 defines therebetween a circumferential width or angle A3, thus representing that grooves 152 are circumferentially equally spaced around perimeter 146. Each groove 152 has a longitudinal center line C1 which is parallel to axis X3 and midway between the parallel circumferentially spaced sides of the given groove 152. Center line C1 is substantially the same distance from axis X3 as is outer perimeter 146 and surface 151. Each groove 152 extends from back 144 to front 142 or front surface 151 and includes a side wall portion 154 which is formed in the side wall of the drum and a gripping or jaw portion 156 which is formed in a respective one of jaws 150 extending inwardly from the outer surface of the jaw which faces away from axis X3. The jaw portion 156 includes multiple semicircular arcuate gripping ridges which are generally perpendicular to the length of groove 152 and serve as a clamping surface for gripping or clamping wire pieces 2 during nail head formation. Grooves 152 lie on and travel along a common circular path which is concentric about axis X3 and which is defined by or adjacent outer perimeter 146.

A pair of circular ejector grooves 158 (FIG. 7) are formed in the side wall of drum 20 extending radially inwardly from outer perimeter 146 in the same manner as the previously discussed ejector grooves in transmitters 16 and 18. Each groove 158 is concentric about axis X3. Each groove 158 is deeper than each groove 152 and thus has a bottom 160 which is further from outer perimeter 146 and closer to axis X3 than a bottom 162 of each groove 152. Grooves 158 communicate with and intersect each groove 152 perpendicular thereto so that a given wire piece 2 when positioned within a groove 152 is perpendicular to and within a portion of grooves 158. A pair of magnet mounting holes 164 is formed in the side wall of drum 20 extending radially inwardly from outer perimeter 146 adjacent and in communication with each groove 152. A respective pair of magnets 166 are mounted securely within holes 164 radially inward of the given groove 152 for magnetically attracting and holding a given wire piece 2 within groove 152 during the time when the wire piece is carried by drum 20. Magnets 166 are circumferentially equally spaced along outer perimeter 146. The circular outer perimeters 57 of rollers 56 of assembly 52 rollingly engage outer perimeter 146 of drum 20 during the rotation of drum 20 and the rotation of each of rollers 56 about their respective axes, which are parallel to axis X3.

In the exemplary embodiment, jaw drum 20 is directly below transmitter 18 whereby the outer perimeters 112 and 146 of carriages 18 and 20 form a generally figure 8-shaped configuration as viewed from the front and generally parallel to axes X2 and X3 although the upper circular portion of the "8" defined by outer perimeter 112 is substantially smaller than the lower circular portion defined by outer perimeter 146 inasmuch as the diameter of drum 20 defined by outer perimeter 146 is substantially larger than that of transmitter 18. Outer perimeter 112 and outer perimeter 146 are closest to one another adjacent a position P5 (FIG. 4) which is directly between axes X2 and X3 and closely adjacent and below the bottom of outer perimeter 112 and closely adjacent and above the top of outer perimeter 146. Tangents of outer perimeter 112 and 146 adjacent position P5 are horizontal and parallel to one another. In the area adjacent position P5, the upwardly facing portion of outer perimeter 146 of the top side of jaw drum 20 faces the downwardly facing portion of outer perimeter 112 of the bottom side of transmitter 18 while the downwardly facing portion of outer perimeter 146 of the bottom side of drum 20 is distal and faces away from the upwardly facing portion of outer perimeter 112 of the top side of transmitter 18. Position P5 is adjacent lower end 136 of plate 50 and surface 138. Grooves 152, jaws 150, magnets 166 and grooves 114 move sequentially and repeatedly adjacent position P5 along their respective circular paths during rotation of carriages 18 and 20.

Figure 6:
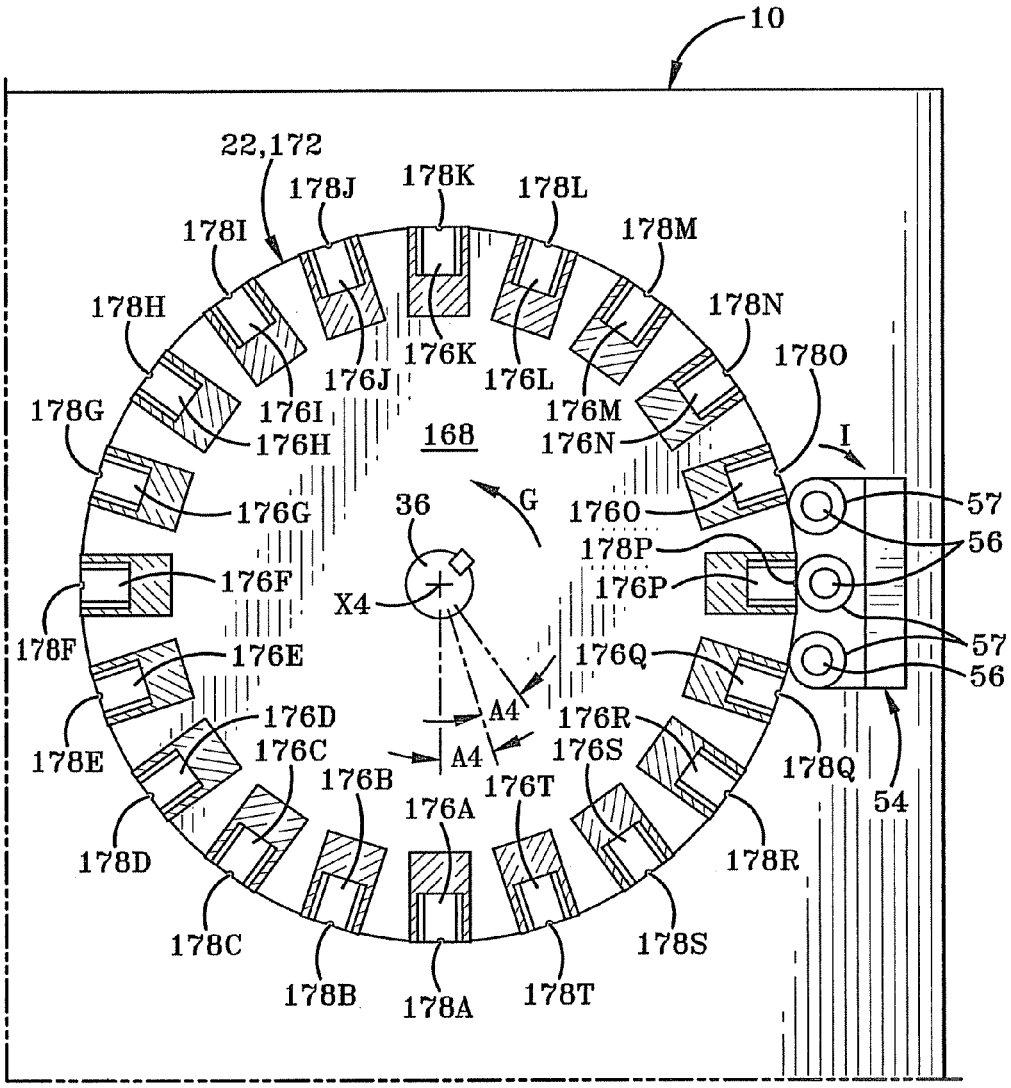
FIG. 6 is an enlarged front elevational view of the right jaw drum with housing of the nail head formers shown in section so that the jaws are visible.
Figure 8:
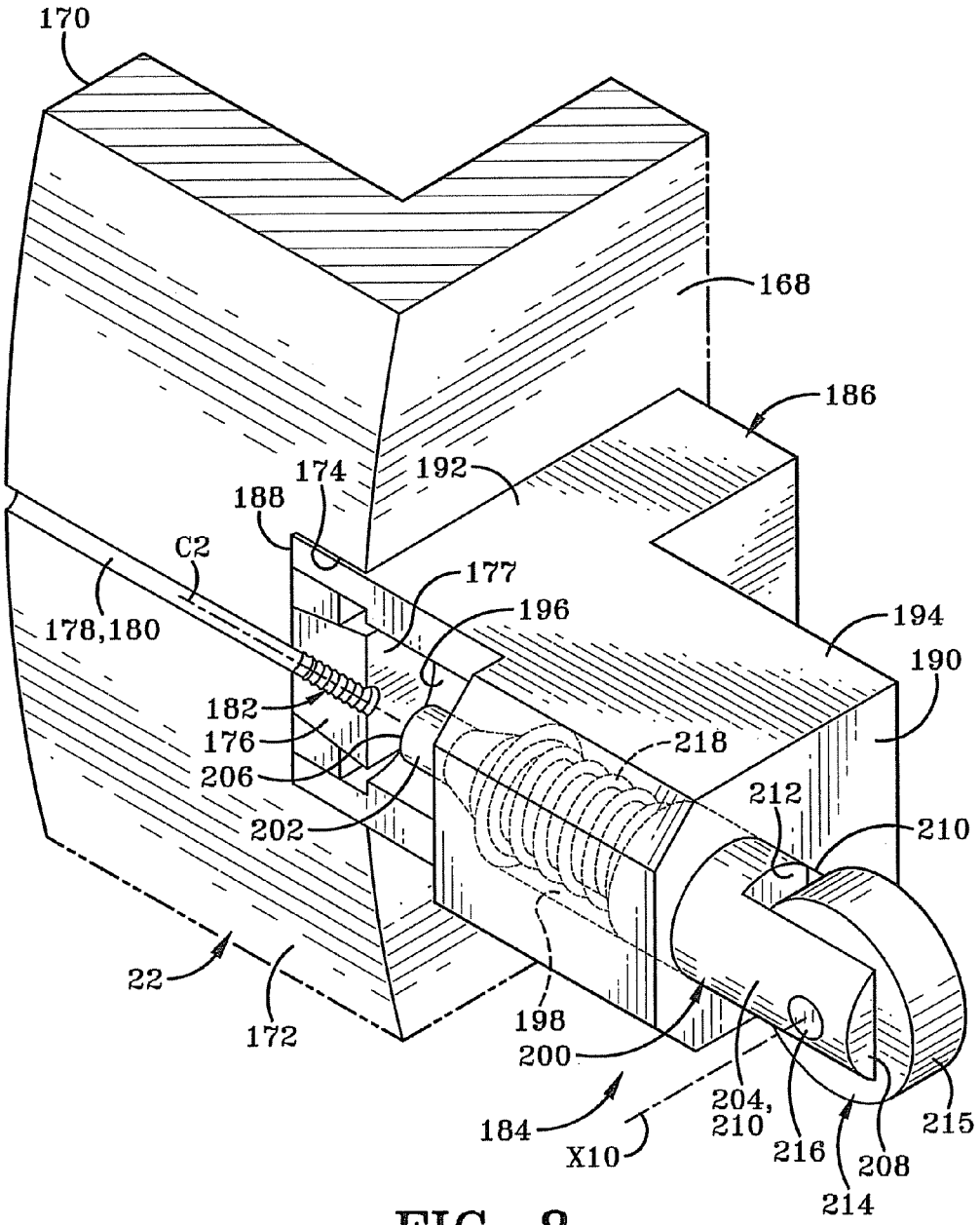
FIG. 8 is a perspective view with portions cut away and portions in section showing a portion of the right jaw drum which illustrates one of the jaws, the corresponding wire piece receiving groove and one of the nail head formers.
Figure 9:
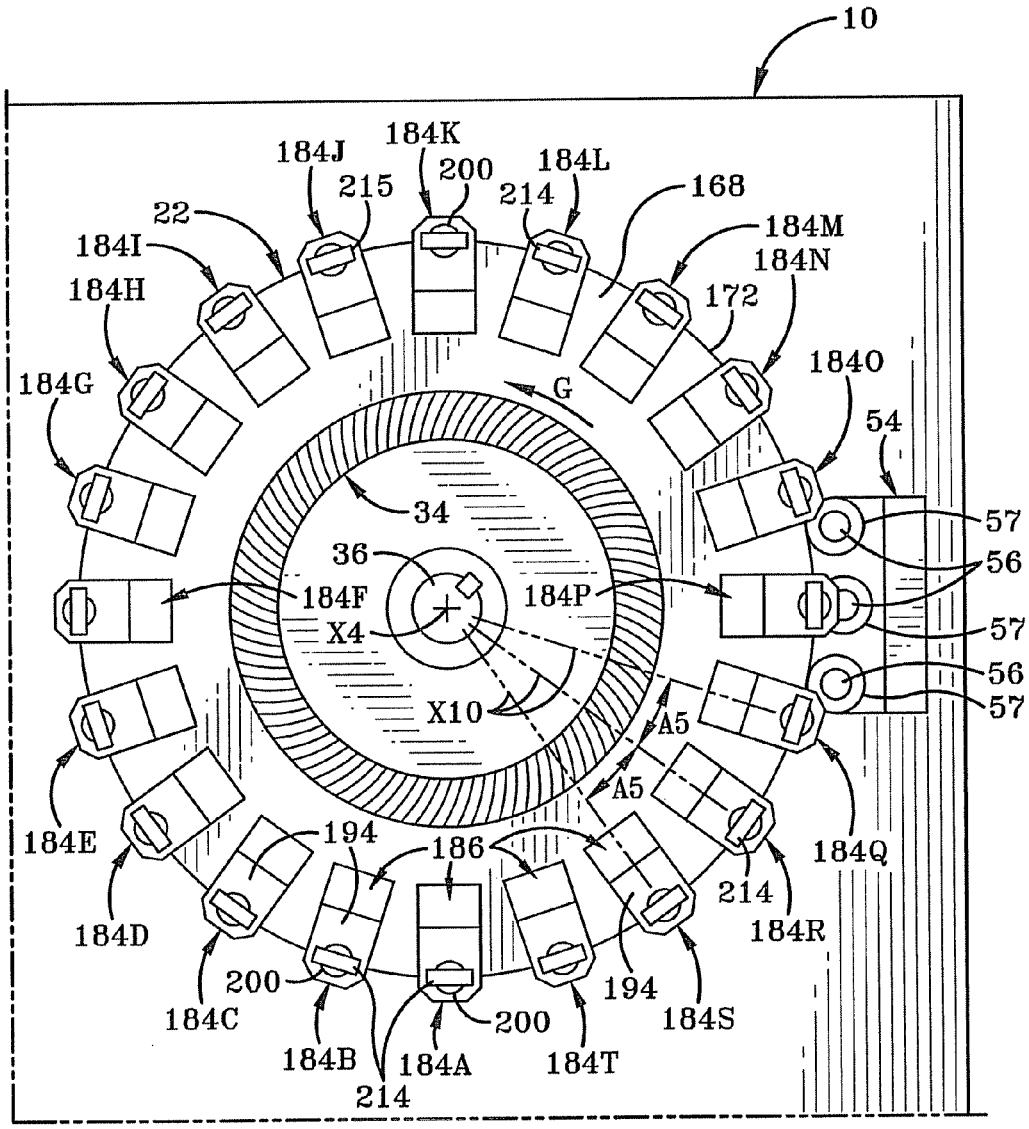
FIG. 9 is an enlarged front elevational view of the jaw drum with the nail head formers mounted thereon.

With primary reference to FIGS. 6, 8 and 9, carriage or drum 22 is now described in greater detail. The main body of drum 22 has a front or front surface 168, a back or back surface 170 (FIG. 8) and a circular or cylindrical outer perimeter 172 which extends from front 168 to back 170 and is concentric about axis X4. Perimeter 172 defines a circular path along which perimeter 172 travels during rotation of carriage 22. Outer perimeter 172 defines a diameter which is substantially the same as the diameter of drum 20. Multiple circumferentially spaced recesses 174 are formed in drum 22 extending radially inwardly from outer perimeter 172 and rearwardly from front 168. Recesses 174 are circumferentially evenly spaced from one another and receive therein jaws 176A-T respectively such that the jaws 176 are likewise circumferentially evenly spaced from one another adjacent the outer perimeter 172. Each jaw 176 has a flat vertical front surface 177. Jaws 176 lie on and travel along a common circular path which is concentric about axis X4 and which is defined by or adjacent outer perimeter 172. Each of the front surfaces 88, 111, 142 and 168 of the respective carriages 16, 18, and 22 lies in a vertical plane perpendicular to axes X1-X4 so that these front surfaces may be coplanar or may lie in planes which are parallel and adjacent one another. Carriage 16, 18, 20 and 22 are positioned so that a single plane perpendicular to axes X1-X4 cuts through all of carriages 16, 18, 20 and 22.

A plurality (twenty in the exemplary embodiment) of wire piece receiving grooves 178A-T are formed in the side wall of drum 22 extending radially inwardly from outer perimeter 172 respectively adjacent and in communication with recesses 174. The surface defining each groove 178 serves as a wire piece engaging surface which may also be denoted at 178. Grooves 178 are circumferentially evenly spaced along perimeter 172 and are in their entirety adjacent perimeter 172. FIG. 6 shows each adjacent pair of grooves 178 defines therebetween the same circumferential width or angle A4, which is equal to angle A3 in the exemplary embodiment. Grooves 178 extend from back 170 to front 168 or front surface 177 and are straight and parallel to axes X1-X4, to one another and to grooves 94, 114 and 152.

Grooves 178 include a side wall portion 180 formed in the side wall of drum 22 and a gripping or jaw portion 182 formed in the respective jaw 176 extending inwardly from the outer surface of the jaw which faces away from axis X4. The jaw portion 182 is formed with semicircular arcuate gripping ridges which are perpendicular to the length of the given groove 178 and serve as a clamping or gripping surface for clamping or gripping wire pieces 2 during nail head formation. Each groove 178 has a longitudinal center line C2 which is parallel to axis X4 and midway between the circumferentially opposed parallel sides of the given groove 178. Center line C2 is parallel to center line C1 and is substantially the same distance from axis X4 as is outer perimeter 172 and surface 177. As shown in FIG. 6, the circular outer perimeters 57 of the respective rollers 56 of assembly 54 rollingly engage outer perimeter 172 of drum 22 during rotation of drum 22 about axis X4 and rotation of rollers 56 about their respective axes, which are parallel to axis X4. Grooves 178 lie on and travel along a common circular path which is concentric about axis X4 and which is defined by or adjacent outer perimeter 172.

Outer perimeter 172 of drum 22 and outer perimeter 146 of drum 20 together form a figure 8-shaped configuration (FIG. 1) wherein the "8" is turned on its side in that the outer perimeter 146 is directly to the left of the outer perimeter 172. Outer perimeters 146 and 172 are closest to one another at or adjacent a nail head forming position P6 (FIG. 12) which is directly between axes X3 and X4 and adjacent the rightmost portion of outer perimeter 146 and the leftmost portion of perimeter 172. Position P6 is directly between outer perimeters 146 and 172 where they are closest to one another. Position P6 is also directly between the leftmost portion of outer perimeter 146 and the rightmost portion of outer perimeter 172, that is, directly between the outer perimeters 146 and 172 where they are furthest from one another. Position P6 is also directly between roller assemblies 52 and 54 and in particular directly between the middle roller 56 of assembly 52 and the middle roller 56 of assembly 54. Adjacent position P6, outer perimeters 146 and 172 are closely adjacent or in contact with one another. The rightward facing portion of outer perimeter 146 on the right side of left jaw drum 20 is directly opposite and faces the leftward facing portion of outer diameter 172 of the left side of right jaw drum 22 while the leftward facing portion of outer perimeter 146 of jaw drum 20 faces away from and is distal the rightward facing portion of outer perimeter 172 of the right side of right drum 22.

With primary reference to FIGS. 8 and 9, drum 22 carries a plurality (twenty in the exemplary embodiment) of nail head formers 184A-T which are equally circumferentially spaced from one another and respectively mounted adjacent the recesses 174, jaws 176A-T and grooves 178A-T. Formers 184 lie on and travel along a common circular path which is concentric about axis X4 and which is defined by or adjacent outer perimeter 172. Each nail head former 184 in the exemplary embodiment is in the form of a punch assembly and includes a block or housing 186 having a back 188 and a front 190. Block 186 is typically formed of a rigid piece of metal and includes a back portion 192 and a front portion 194 rigidly secured to and extending forward from back portion 192. Back portion 192 adjacent back 188 is received within one of recesses 174 so that block or housing 186 is rigidly secured to the body of drum 22 adjacent outer perimeter 172. Front portion 194 extends radially outwardly away from axis X4 and beyond back portion 192 and overhangs a space 196 which is directly behind front portion 194 and is defined in back portion 192 extending radially inwardly from the outer surface of back portion 192. Space 196 may be referred to as a nail head receiving space, a wire piece head end receiving space and/or a punch head receiving space. A through passage 198 is formed in front portion 194 extending from and communicating with space 196 forward to the front 190 of housing 186.

A punch 200 is movably carried within passage 198 and includes a punch head 202 which extends rearwardly from passage 198 into space 196, and a punch tail 204 which extends forward from the front of passage 198 external thereto. Punch head 202 has a back or rearwardly facing forming or punching surface 206 which faces and is adjacent the forward facing front forming surface 177 of the corresponding jaw 176. Tail 204 defines a forward facing front surface 208 of punch 200 and includes a pair of spaced legs 210 which are more particularly spaced from one another by a notch 212 defined in tail 204 extending rearward from front surface 208. A rotatable roller 214 has a circular outer perimeter 215 and is rotatably mounted on tail 204 by an axle 216 which is secured to and extends between legs 210. More particularly, each axle 216 defines an axis X10 about which roller 214 is rotatable. Each axis X10 is perpendicular to axis X4 and lies along or is a radius of axis X4. Three of the axes X10 are shown in FIG. 9 respectively associated with the rollers 214 of formers 184Q-S. In keeping with the fact that the formers 184 are equally circumferentially spaced along the outer perimeter of drum 22, FIG. 9 shows that rollers 214 and their axes X10 are likewise equally circumferentially spaced. More particularly, each adjacent pair of axes X10 defines therebetween a circumferential width or angle A5 which is the same as Angle A4 (FIG. 6) defined between each adjacent pair of grooves 178. In the exemplary embodiment, grooves 178 lie respectively directly behind axes X10.

Figure 13:
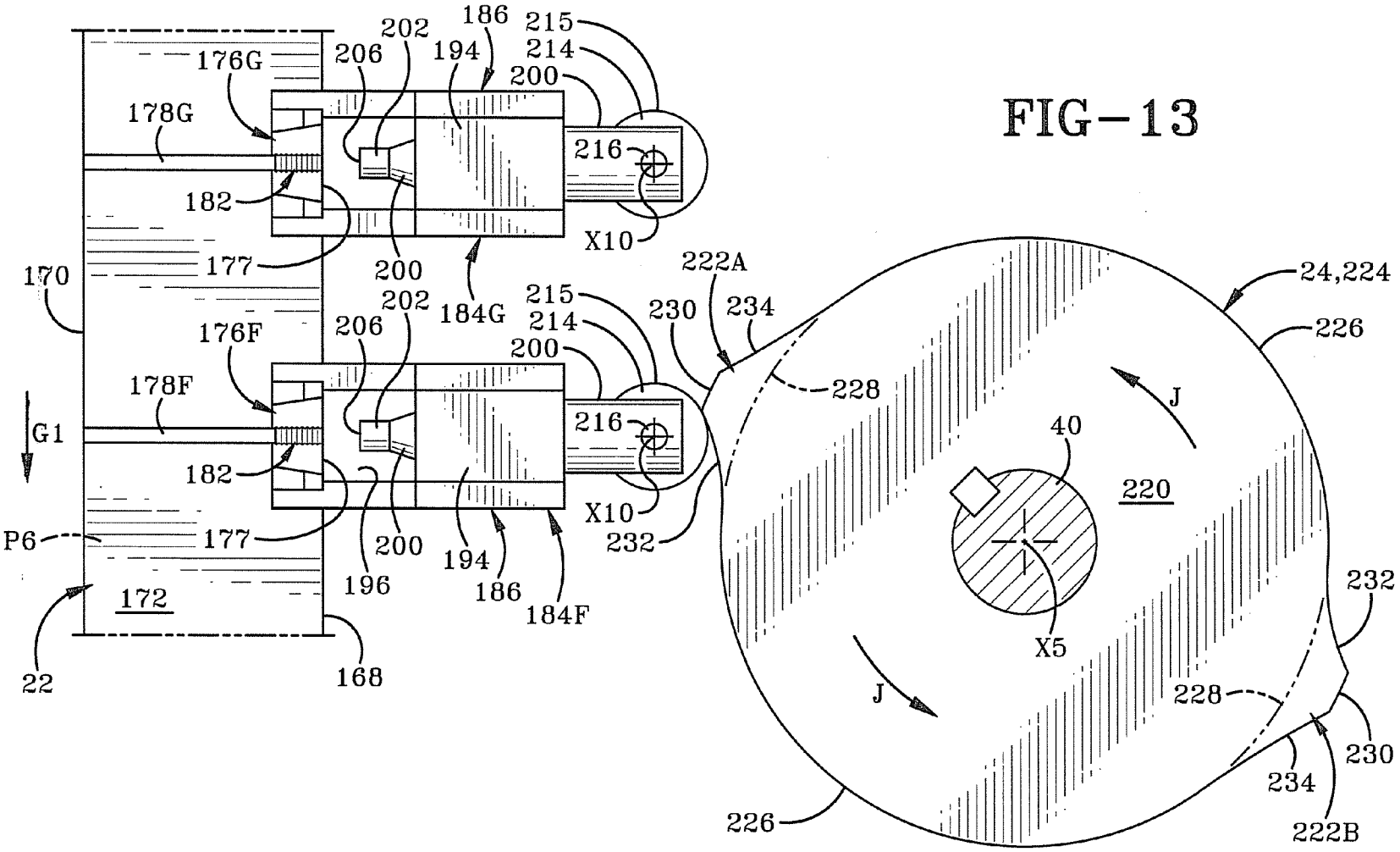
FIG. 13 is an enlarged left side elevational view taken just to the left of the cam and showing only the cam, a pair of the nail head formers and a portion of the jaw drum which carries the head formers.

A coil spring 218 (FIG. 8) is disposed in passage 198 and biases punch 200 and roller 214 to a non-punching position shown in FIGS. 8 and 13. As shown in FIG. 8, punch head 202 is aligned with the corresponding groove 178 directly in front of the front of groove 178. Center C2 of groove 178 also serves as the longitudinal center of punch 202 and the center of punching surface 206. In the exemplary embodiment, punch 200 moves relative to the body of drum 22, jaw 176 and housing 186 only in a straight linear manner back and forth between the non-punching position and a punching position illustrated in FIGS. 14 and 15 by the punch of former 184F. Thus, each punch 200 is movable back and forth in a linear manner parallel to axes X1-X4 and to the various wire piece receiving grooves 94, 114, 152 and 178.

With primary reference to FIG. 13, cam 24 is described in greater detail. Cam 24 is a rigid structure which is substantially disk-shaped and typically made out of metal. Cam 24 has a substantially flat circular cam body 220 and a pair of opposed cam lobes 222A and B extending radially outwardly from body 220. Cam 24 has an outer perimeter 224 which includes a pair of opposed circular arc portions 226 which are nearly semicircular and lie along a circular path 228 concentric about axis X5. Each cam lobe 222 has an outermost surface or peak 230, a tapered leading end 232 which slopes radially outwardly from an end of one of arc portions 226 to peak 230, and a tapered trailing end 234 which slopes radially outwardly from an end of the other arc portion 226 to peak 230. The peaks 230 and the leading and trailing ends 232 and 234 are part of outer perimeter 224.

The operation of machine 1 will now be described beginning with a general description of the overall process. Generally, wire W unwinds from spool 8 (FIG. 1) to be fed downstream therefrom through the remainder of the machine. The counter rotating feed wheels 58A and B of wire feeder 12 feed wire W from position P1 (FIG. 2) to and past position P2 (FIG. 2) adjacent cutter 14 so that cutter 14 cuts wires into wire pieces 2 and sequentially delivers the wire pieces to the grooves 94 while located at position P3. Transmitter 16 rotates to carry the wire pieces magnetically held in the grooves sequentially from position P3 down to position P4 (FIG. 4), adjacent which the wire pieces are sequentially transferred respectively to grooves 114 adjacent the top of transmitter 18. The wire pieces then travel within the respective grooves 114 while being retained therein by plate 50 so that transmitter 18 delivers the wire pieces 2 sequentially from adjacent position P4 to adjacent position P5, adjacent which ejector 46 facilitates the sequential transfer of the wire pieces into respective grooves 152 adjacent the top of drum 20. Drum 20 rotates to carry and sequentially deliver the wire pieces held magnetically within grooves 152 from adjacent position P5 to position P6 (FIG. 12) directly between drums 20 and 22. At position P6, cam 24 drives the punching operation of nail head formers 184 to sequentially form the heads of the nails from the wire pieces, which are subsequently sequentially carried by drum 20 while still magnetically held in the grooves 152 from position P6 to an ejection or removal position adjacent the bottom of drum 20, where ejector 48 sequentially removes the newly formed nails from grooves 152 of drum 20 to sequentially transfer them into bin 26 or the like.

As previously discussed, machine 1 includes a synchronized drive assembly in order to drive the various components of the sequential wire piece positioner so that straight wire pieces 2 are cut and delivered through machine 1 in a sequential manner. This sequential feeding, delivery and processing of the wire pieces and nails is illustrated by the specific numbering of the wire pieces 2 and nails 4. More particularly, FIG. 1 shows the various nails 4 moving into bin 26, followed by nails 4A, 4B, 4C, 4D, 4E and 4F (FIG. 5), which is the sequential order in which the nails were formed and are being delivered to ejector 48 to be transferred into bin 26. Similarly, the wire pieces are denoted in the order of sequential movement through the system of machine 1 at 2A-2Q wherein wire pieces 2A-2D are shown within respective grooves 152G-152J of drum 20 in FIG. 5, wire pieces 2E-2J are shown respectively within grooves 114A-114F of transmitter 18 in FIG. 4, and wire pieces 2K-2Q are shown respectively within grooves 94A-94G in FIGS. 2-4. To move wire pieces 2 and nails 4 in this sequential manner through machine 1, the various rotating carriages and wheels are rotated in a synchronized manner as detailed below.

This synchronized movement includes the rotation of the motor and gears of drive assembly 28 in a continuous manner (and usually at a substantially constant rate) such that feed wheels 58 and cutter wheels 74 are rotated continuously (usually at a substantially constant rate) which withdraws wire W (Arrow A in FIG. 1) from spool 8 in an intermittent fashion. This is due to the use of alternating arms 62 and blank areas 64 on feed wheels 58. More particularly, the rotation of wheels 58A and B (Arrows B in FIG. 2) so that one rotates clockwise and the other rotates counterclockwise causes the surfaces that define grooves 72 of a given pair of synchronized arms such as arms 62A to grip opposed sides of wire W at position P1 and move it forward a length equal to the circumferential length of grooves 72. Once grooves 72 are out of contact with wire W, the movement of wire W stops momentarily during the length of time it takes for a given set of blank areas such as areas 64A to move adjacent and past wire W so that the leading edges 66 of the next set of grooves 72 moves into contact with wire W to once again move wire W forward a distance equal to the circumferential length of groove 72. The intermittent feeding of wire W thus positions wire W so that it extends forward from the gripping position P1 to and forward of or beyond the cutting position P2 so that the rotation of cutter wheels 74 (Arrows C in FIG. 2) with one cutter wheel rotating clockwise and the other counterclockwise causes a given pair of cutting tips such as tips 76A to move to position P2 to cut or sever wire W in order to form and separate a wire piece 2 from the remaining length of wire being unwound from spool 8. Feed wheels 58 thus feed wire W to a position adjacent the groove 94 which is at wire piece receiving position P3, and the rotating tips 76 which cut wire W also push the newly cut wire piece 2 into the groove 94 at position P3. As previously noted, the cutter tips 76 are configured to form the wire piece with its head end 3 and sharpened tip end 5. The feed and cutting system thus provides wire pieces 2 all of which are substantially the same length. Wire pieces 2 when positioned within grooves 94 are horizontal and parallel to grooves 94, 114, 152 and 178, to one another and to axes X1-X4, and remain in this orientation while being carried in grooves 94, 114 and 152.

The synchronization of the sequential wire positioner includes the intermittent rotation (Arrows D in FIGS. 1-3) of carriage 16 by intermittent drive assembly 30 (FIG. 1) so that one of the carriage 16 grooves such as groove 94G stops momentarily at position P3 (FIG. 2) and the opposed groove such as groove 94A simultaneously stops momentarily adjacent position P4 (FIG. 4). Thus, while the given groove 94 is stopped at position P3, wire feeder and cutter 14 are synchronized to feed the given wire piece 2 into the groove 94 at position P3. After a given wire piece 2 is fed into the groove 94 at position P3, the intermittent drive assembly causes subsequent rotation of carriage 16 to advance the circumferential distance A1 (FIG. 4) between an adjacent pair of grooves 94, thus advancing, for example groove 94G out of position P3 to the position shown by groove 94F in FIGS. 2 and 3 and simultaneously advancing the next or sequential groove 94H (FIG. 3) to position P3, at which time the rotation of transmitter 16 momentarily stops again in order to receive the next or sequential wire piece 2 fed, cut and transferred by feeder 12 and cutter 14 in a synchronized manner. The intermittent drive assembly thus intermittently rotates or advances transmitter 16 a specified circumferential distance or step A1 from a first momentarily stopped position to another momentarily stopped position.

Figure 10:
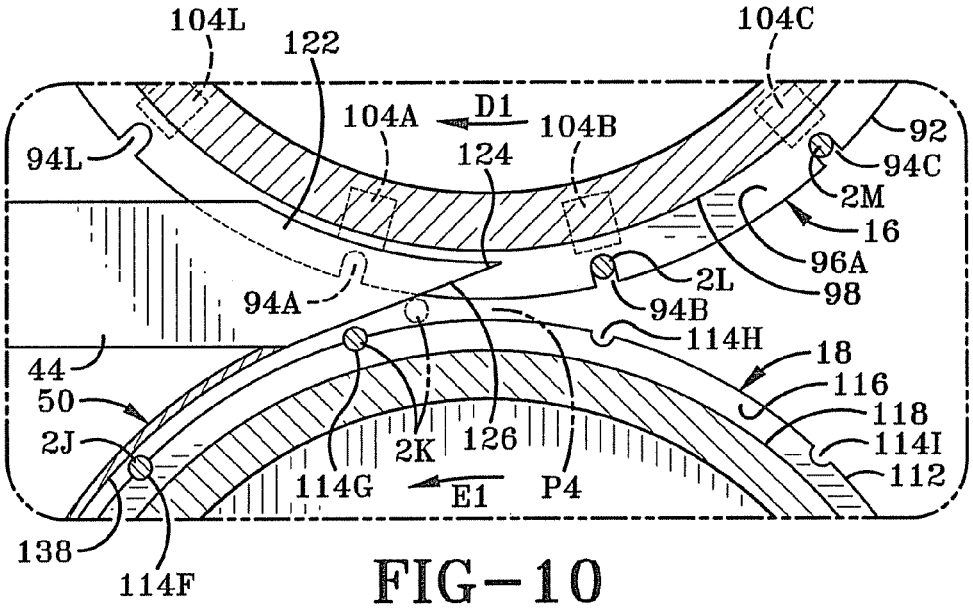
FIG. 10 is an enlarged sectional view similar to the upper portion of FIG. 4 showing the transfer of a wire piece from the upper transmitter to the lower transmitter.

During the rotational step advancement of transmitter 16 to move a groove 94 with a wire piece 2 therein out of position P3 and the next groove into position P3, the wire piece 2 in the groove 94 opposite position P3 and adjacent wire piece transfer position P4 also advances and is ejected or stripped out of its groove to be transferred into a groove of transmitter 18. By way of example, as groove 94G and wire 2Q (FIG. 2) is advancing one circumferential step out of position P3 to the next position, FIGS. 4 and 10 illustrate that groove 94A moves generally horizontally and upward to the left (Arrow D1 in FIG. 10) while ejector 44 forces wire piece 2K out of groove 94A and into groove 114G of transmitter 18, which is rotating in the direction opposite of transmitter 16 in a continuous fashion with grooves 94A and 114G moving in a synchronized manner to be closely adjacent one another when substantially aligned with position P4 and also while continuing a short distance beyond position P4. Thus, the rotation of transmitters 16 and 18 from the position shown in FIG. 4 to the position shown in FIG. 10 causes wire piece 2K to slidingly engage cam surface 126 of ejector 44, which translates the rotational movement of wire piece 2K with transmitter 16 into downward movement radially outwardly away from axis X1 to remove wire piece 2K from groove 94A and simultaneously guide wire piece 2K toward and then into groove 114G, which is closely adjacent and substantially directly below groove 94A at the time that wire piece 2K is ejected from groove 94A adjacent position P4 and received in groove 114G. The sliding engagement between wire piece 2K and cam surface 126 thus produces sufficient radially outward force on wire piece 2K away from axis X1 to overcome the magnetic attraction of wire piece 2K to magnet 104A, at which time wire piece 2K falls by gravitational force into groove 114G as groove 114G rotates with transmitter 18 (Arrow E1 in FIG. 10) substantially horizontally and downwardly to the left.

Grooves 94 rotate along a common circular path which is defined by or adjacent the outer perimeter or circular path 92 of transmitter 16. Thus, when parallel wire pieces 2 are disposed within the respective grooves 94, they likewise travel along a circular path concentric about axis X1 which is on or adjacent circular path 92. Similarly, magnets 104 rotate along a circular path concentric about axis X1 adjacent and radially inward of outer perimeter or path 92 and the circular paths along which grooves 94 and wire pieces 2 travel. The rotation of carriage 16 moves grooves 94 and wire pieces 2 carried thereby sequentially from position P3 to adjacent position P4. In the exemplary embodiment, wire pieces 2 are disposed only in some of grooves 94 during normal operation, and more particularly within one half or approximately one half of grooves 94 along one side of transmitter 16 while the grooves 94 on the other side are empty due to the transfer of wire pieces adjacent position P4 to transmitter 18. Once wire pieces 2 have been transferred out of grooves 94 as grooves 94 moves sequentially past position P4, the resulting empty grooves 94 move in the intermittent fashion previously described upwardly away from position P4 back to position P3, where the cycle of rotating transmitter 16 to pick up wire pieces at position P3 and deliver them to position P4 sequentially starts again to facilitate the continual feeding of wire pieces 2 through machine 1.

Similarly, only about half of grooves 114 of transmitter 18 carry parallel wire pieces 2 along the left side thereof while the remaining grooves 114 generally along the right side are empty inasmuch as transmitter 18 receives wire pieces 2 adjacent its top and transfers them to jaw 20 adjacent its bottom. Grooves 114 lie along a common circle concentric about axis X2 and thus travel along a circular path concentric about axis X2 during rotation of transmitter 18. Thus, wire pieces 2 travel along the same circular path concentric about axis X2 on or adjacent outer perimeter or circular path 112 when they are carried within respective grooves 114. As discussed further above, transmitter 18 is free of magnets which are used to magnetically hold or retain wire pieces 2 within the corresponding grooves 114. The arcuate retaining surface 138 of retaining member 50 ensures that the wire pieces 2 do not come out of or exit grooves 114 during their travel from adjacent wire piece transfer position P4 and upper end 134 to adjacent wire piece transfer position P5 and lower end 136. When wire pieces 2 are closer to the top of transmitter 18, gravity alone may hold them within the respective groove 114. However, as the wire pieces within grooves 114 travel downwardly, some sort of retaining mechanism is necessary to keep them within grooves 114. Thus, wire pieces 2 slidably engage surface 138 as they rotate along with transmitter 18 in order to keep the wire pieces within the grooves 114. The rotation of carriage 18 moves grooves 114 and wire pieces 2 carried thereby sequentially from adjacent position P4 to adjacent position P5. As ejector 44 removes wire pieces 2 sequentially from grooves 114 as grooves 114 sequentially move past position P5, the grooves 114 which are empty as a result move back upwardly away from position P5 sequentially toward position P4 so that grooves 114 again sequentially pass by position P4 to repeat the cycle of sequentially receiving wire pieces 2 from transmitter 16 and delivering them again to position P5 for transfer to drum 20.

Figure 11:
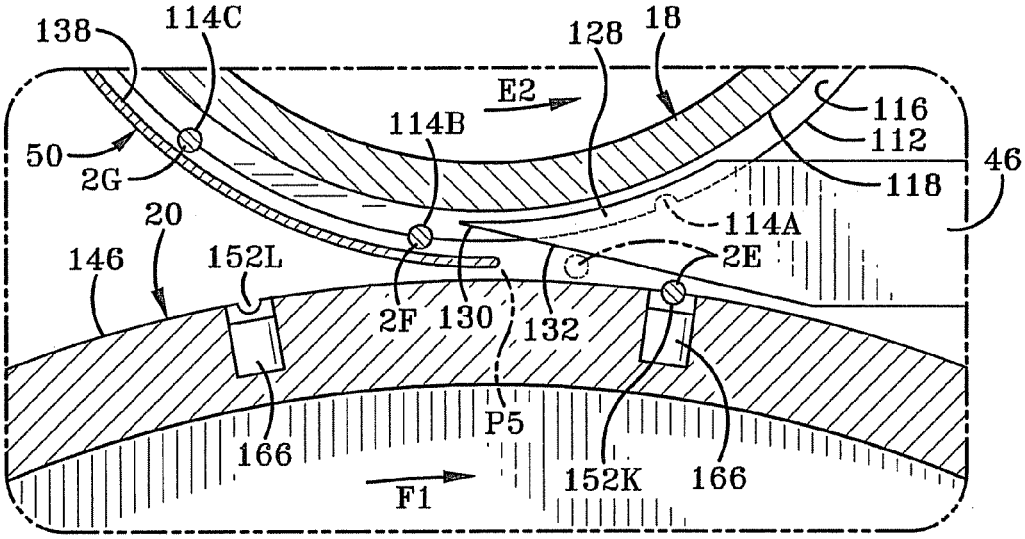
FIG. 11 is an enlarged sectional view similar to the lower portion of FIG. 4 showing the transfer of a wire piece from the lower transmitter to the left jaw drum.

More particularly, wire pieces 2 are sequentially transferred from transmitter 18 to jaw drum 20 once they move beyond the lower terminal end 136 of retaining member 50. This transfer may be facilitated by ejector 46 in a manner similar to that described above with respect to ejector 44 effecting the removal of wire pieces 2 from grooves 94 of transmitter 16. The transfer of wire pieces from transmitter 18 to drum 20 is illustrated in FIGS. 4 and 11. Tip 130 and cam surface 132 thereof is positioned radially inwards of the given wire piece 2E and thus closer to axis X2 so that tip 130 is directly between wire piece 2E and axis X2 just prior to the ejection or removal of wire piece 2E from groove 114A. Tip 130 and the surface 132 thereof is also thus between the bottom 120 of groove 114A and the bottom 118 of groove 116 immediately adjacent bottom 120 of groove 114A just prior to the removal or ejection of wire piece 2E. Wire piece 2E thus slidably engages cam surface 132 to facilitate removal of wire piece 2E from groove 114A in the same manner as discussed above with respect to ejector 44. It is noted that inasmuch as transmitter 18 does not include magnets to retain the wire pieces within the grooves 114 thereof that an ejector such as ejector 46 may not be necessary in order to cause the wire pieces to be removed from groove 114 since this may be achieved by gravity only. However, surface 132 of ejector 46 may also facilitate guiding the wire piece into the corresponding groove 152 of drum 20.

In any case, wire piece 2E comes out of groove 114A as groove 114A rotates (Arrow E2 in FIG. 11) generally horizontally and upward to the right as groove 114A and wire piece 2E move past the lower end 136 of retaining member 50 while the receiving groove 152K and corresponding magnet 166 rotate (Arrow F1 in FIG. 11) with drum 20 generally horizontally and downwardly to the right. When grooves 114A and 152K are adjacent position P5 and lower end 136 due to the synchronized movement of grooves 152 and 114, they are substantially aligned with one another, more particularly with groove 152K directly below groove 114A, whereby the transfer of wire piece 2E may be facilitated by gravity, magnetic attraction of the magnet 166 adjacent groove 152K and the sliding engagement of wire piece 2E with surface 132 of ejector 46. The rotation of carriage 18 thus moves grooves 114 and delivers wire pieces 2 carried thereby sequentially to adjacent jaws 150, grooves 152 and the corresponding magnets 166 while adjacent position P5 as carriage 20 rotates.

The transfer of wire pieces 2 from transmitter 18 to jaw drum 20 occurs while transmitter 18 is continuously rotating (Arrow E in FIG. 1) in one direction about axis X2 at a predetermined rate while drum 20 is rotating in the opposite direction (Arrow F in FIGS. 1 and 5) about axis X3 at a predetermined rate so that respective grooves 114 and 152 are synchronized to sequentially be closely adjacent one another adjacent position P5 in order to properly transfer the parallel wire pieces from their respective grooves 114 to their respective grooves 152 in sequential manner. Meanwhile, drum 22 is rotating (Arrow G in FIG. 1) in a direction opposite that of drum 20. At the same time, as shown in FIGS. 5 and 6, rollers 56 of assembly 52 rotate (Arrow H in FIG. 5) about their respective axes in a direction opposite that of drum 20, and rollers 56 of assembly 54 rotate (Arrow I in FIG. 6) about their respective axes in a direction opposite that of drum 22. More particularly, the circular outer perimeters 57 of rollers 56 of assembly 52 rollingly engage the circular outer perimeter 146 of jaw 20 while the circular outer perimeters 57 of rollers 56 of assembly 54 rollingly engage the outer perimeter 172 of drum 22. Rollers 56 of assemblies 52 and 54 are idler rollers, such that their rotation is driven by engagement with the respective outer perimeters 146 and 172 of the drums 20 and 22 as they are driven by drive assembly 32 (FIG. 1).

Thus, as seen in FIGS. 1, 5 and 6, carriages 16 and 20 and rollers 56 of assembly 54 are rotated in the same direction (clockwise) about their respective axes while carriages 18 and 22 and rollers 56 of assembly 52 all rotate in the opposite direction (counterclockwise) about their respective axes. With respect to carriages 16, 18, 20 and 22, each carriage which is immediately downstream of a given carriage rotates in the opposite direction of the given carriage. For example, carriage 18 is immediately downstream of carriage 16 and thus rotates in the opposite direction as carriage 16. Likewise, carriage 20 is immediately downstream of carriage 18 and rotates in the opposite direction of carriage 18. Likewise, carriage 22 is immediately downstream of carriage 20 and rotates in the opposite direction of carriage 20. It may also be said that each pair of carriages having outer perimeters which are adjacent one another rotate in opposite directions from one another. Thus, one such pair is formed of carriages 16 and 18, another such pair is formed of carriages 18 and 20, and another such pair is formed of carriages 20 and 22. Thus, with reference to FIG. 10 and with respect to carriages 16 and 18, outer diameter 92, grooves 94, magnets 104 and wire pieces 2 within a groove 94 when adjacent position P4 are moving in the generally horizontal direction indicated at Arrow D1 while outer perimeter 112, grooves 114 and a wire piece 2 within a groove 114 when adjacent position P4 are moving in the direction generally indicated at Arrow E1, which is substantially the same as the direction of Arrow D1 when adjacent position P4. A similar relationship exists between carriages 18 and 20 adjacent position P5. Thus, outer perimeter 112, grooves 114 and a wire piece 2 within a given groove 114 adjacent position P5 is moving generally in the direction indicated at Arrow E2 in FIG. 11 while outer perimeter 146, grooves 152, magnets 166 and a wire piece 2 within a groove 152 adjacent position P5 is moving in the generally horizontal direction indicated by Arrow F1 in FIG. 11, which is substantially the same as the direction of Arrow E2 adjacent position P5.

Once a wire piece 2 is transferred from transmitter 18 to drum 20, it is held in a respective groove 152 by the corresponding magnet or magnets 166 as it travels from position P5 adjacent the top of drum 20 to position P6 (FIG. 12), where the nail head is formed as described below to produce nails 4 which continue their travel within grooves 152 while magnetically held therein from position P6 downwardly and to the left to an ejection or transfer position adjacent the bottom of drum 20 and ejector 48, which ejects or removes the nails 4 from their respective grooves 152 in the same manner with respect to ejector 44. Thus, only a portion of grooves 152 carry a wire piece or nail during normal operation. More particularly, about one quarter of grooves 152 carry parallel wire pieces 2 while about another quarter of grooves 152 carry finished nails 4 and the remaining number, typically about half, of grooves 152 are empty along the left side of drum 20 as they return sequentially to position P5 to again sequentially pick up additional wire pieces. The rotation of carriage 20 moves grooves 152 and wire pieces 2 carried thereby sequentially from adjacent position P5 to adjacent position P6.

Figure 12:
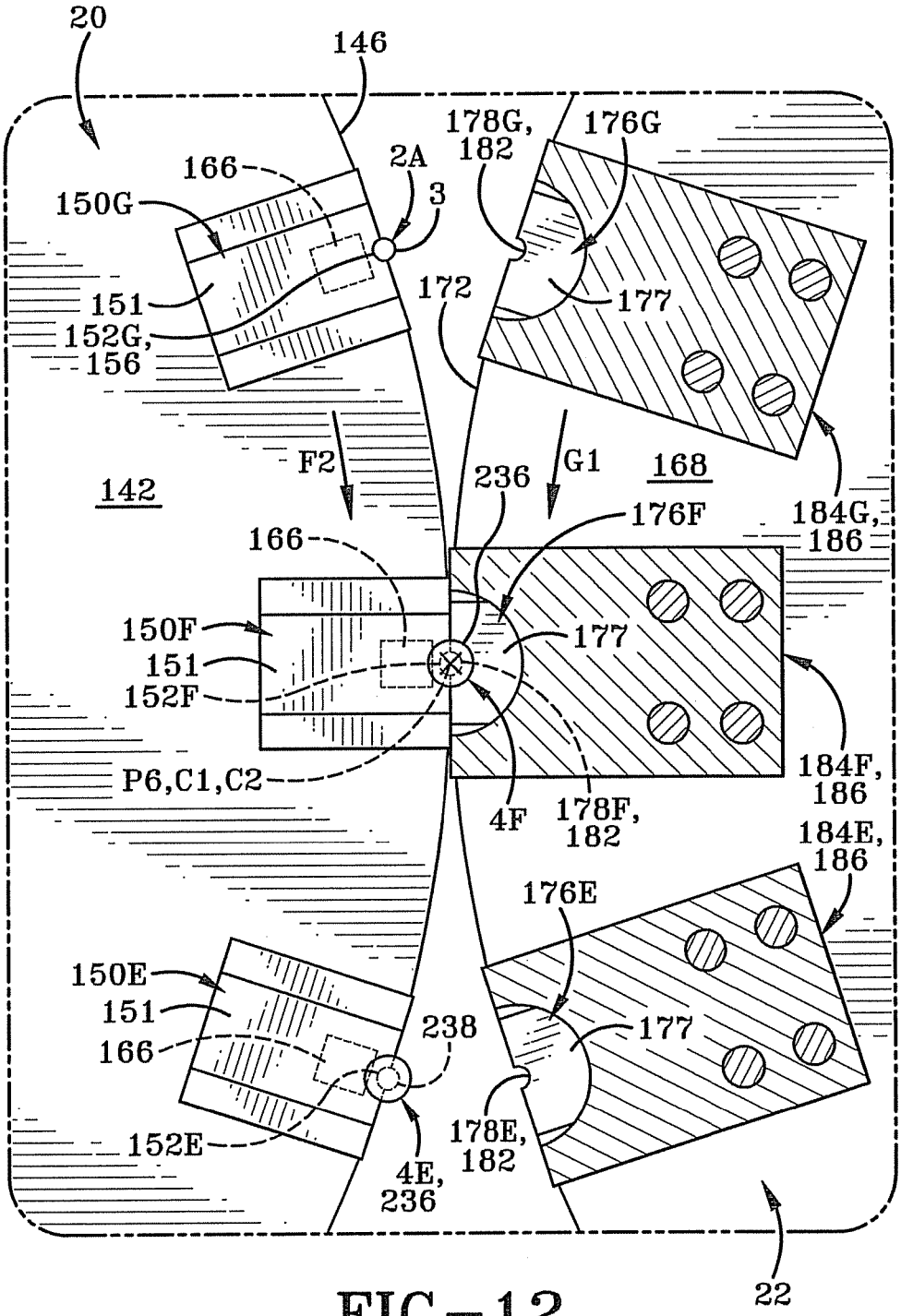
FIG. 12 is an enlarged sectional view taken from the front behind the head forming surface of the punches showing the head forming position between the outer perimeters of the left and right jaw drums with one nail at the head forming position, another nail having moved downstream from the head forming position, and a wire piece carried adjacent one of the jaws on the left drum upstream of the head forming position and moving downstream toward the head forming position.

As previously discussed, the synchronized drive assembly drives rotation of drums 20 and 22 in a synchronized manner whereby grooves 152 of drum 20 (and wire pieces 2 in grooves 152) and grooves 178 of drum 22 are sequentially positioned in a synchronized manner adjacent one another and head forming position P6, which can be understood by reference to FIG. 12. More particularly, the synchronized movement of grooves 152 and 178 in FIG. 12 shows grooves 152F and 178F meeting or closely adjacent one another and position P6 at which the nail head is formed whereas grooves 152E and 178E have moved past position P6 after the formation of the nail head on nail 4E, and grooves 152G and 178G are moving toward but have not yet arrived at position P6. Thus for instance, grooves 152E and 178E have already moved through the positions shown by grooves 152G and 178G, and then the positions shown by grooves 152F and 178F until reaching the position shown in FIG. 12. Unlike the other carriages, carriage 22 is not configured to carry a wire piece 2 or nail 4 within its grooves 178, but does receive one, and only one, wire piece within one groove 178 just prior to rotating to position P6, and at position P6 where the head is formed to create a nail 4, whereby the shaft of the nail remains at least partially within the given groove 178 for a short period immediately after rotating past position P6. Thus, all of the other grooves 178 at this time are empty or free of wire pieces or nails. Inasmuch grooves 178 are not configured to carry wire pieces 2 or nails 4 aside from the relatively short period during which a wire piece or nail is within a given groove 178 at and adjacent position P6, carriage 22 is free of magnets generally and more particularly free of magnets adjacent grooves 178 for magnetically attracting or retaining wire pieces or nails within the grooves. It is noted that centerlines C1 and C2 of a pair of grooves 152 and 178 positioned adjacent position P6 coincide momentarily at position P6 whereby centerlines C1 and C2 at position P6 define a longitudinal centerline of that pair of grooves and of the wire piece 2 or nail 4 while at position P6.

The sequential positioner also sequentially positions jaws 150 and the magnets 166 associated therewith adjacent position P6 as jaw drum 20 rotates to carry these components past position P6. The sequential positioner also sequentially positions jaws 176 and nail head formers 184 sequentially adjacent position P6 as they are carried by the rotation of carriage 22. This occurs more particularly as the right side of carriage 20 rotates downwardly (Arrow F2) and the left side of carriage 22 rotates downwardly (Arrow G1) adjacent position P6. Thus, the positioner also in a synchronized manner sequentially positions jaws 150, grooves 152, the corresponding magnets 166 and parallel wire pieces 2 within grooves 152 respectively adjacent jaws 176, grooves 178 and nail head formers 184 as they pass by position P6. As carriages 20 and 22 rotate, outer perimeter 146, grooves 152, jaws 150, magnets 166 and wire pieces 2 or nails 4 within a groove 152 adjacent position P6 moves generally in the direction indicated by Arrow F2 and more particularly substantially straight down while outer perimeter 172, grooves 178, jaws 176 and formers 184 when adjacent position P6 move generally vertically in the direction indicated by the Arrow G1 and more particularly substantially straight down whereby all of these components are moving in substantially the same direction adjacent position P6. As nails 4 are formed at position P6, they are then sequentially transferred away from position P6 within respective grooves 152 to the bottom of drum 20, where they are sequentially removed by ejector 48 whereby the resulting empty grooves 152 move upwardly from adjacent the bottom of the drum and ejector 48 back to position P5 to continue the cycle of picking up wire pieces 2 therein and carrying them from position P5 to position P6.

Figure 14:
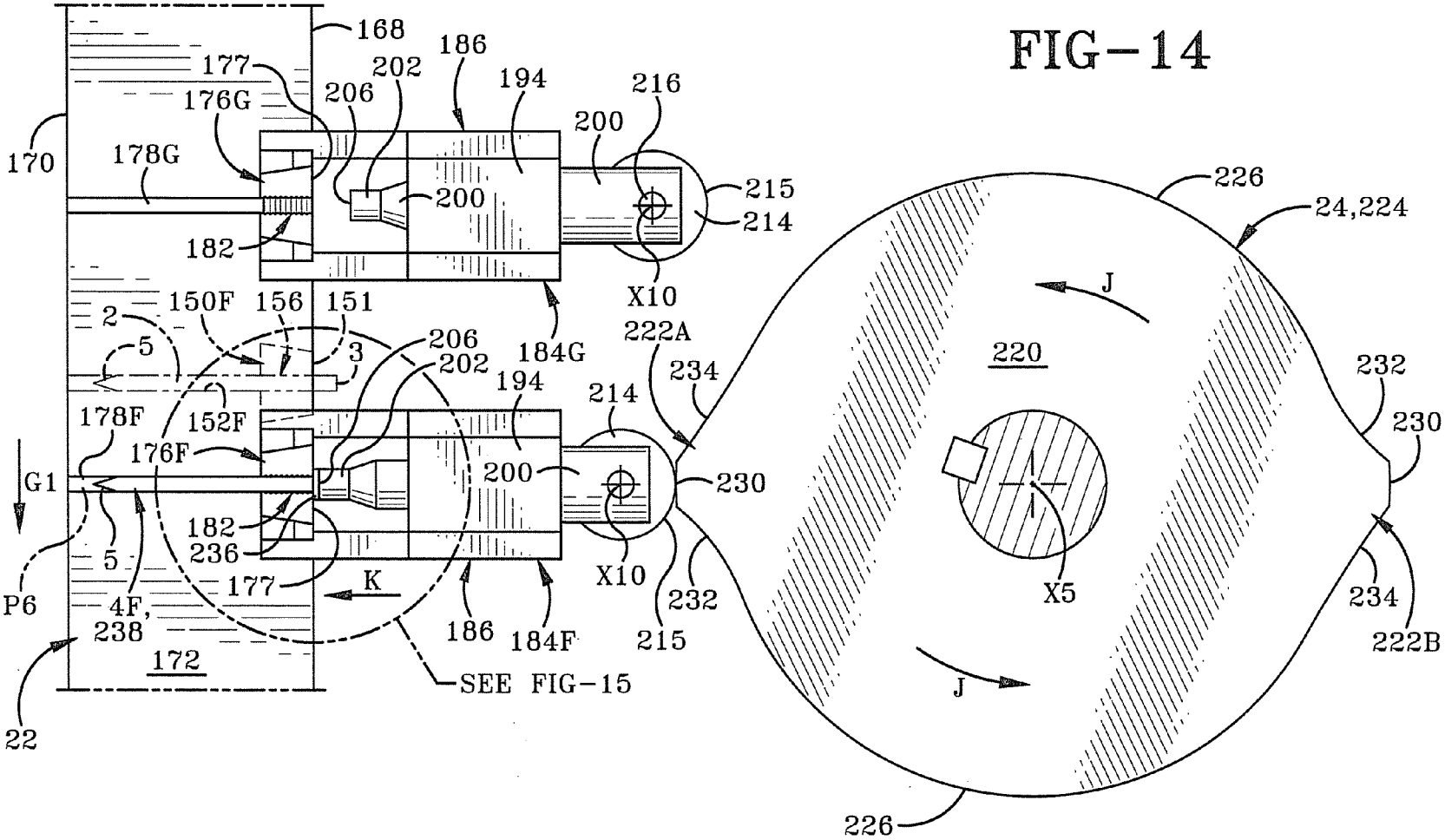
FIG. 14 is similar to FIG. 13, is at the same stage as FIG. 12, and shows the cam lobe of the cam having rotated to engage the wheel of the punching assembly to move the punch to the punching position to form the circular head on the wire piece which was inserted into the corresponding groove immediately prior to the head forming position whereby the forming of the head completes the formation of the nail.
Figure 15:
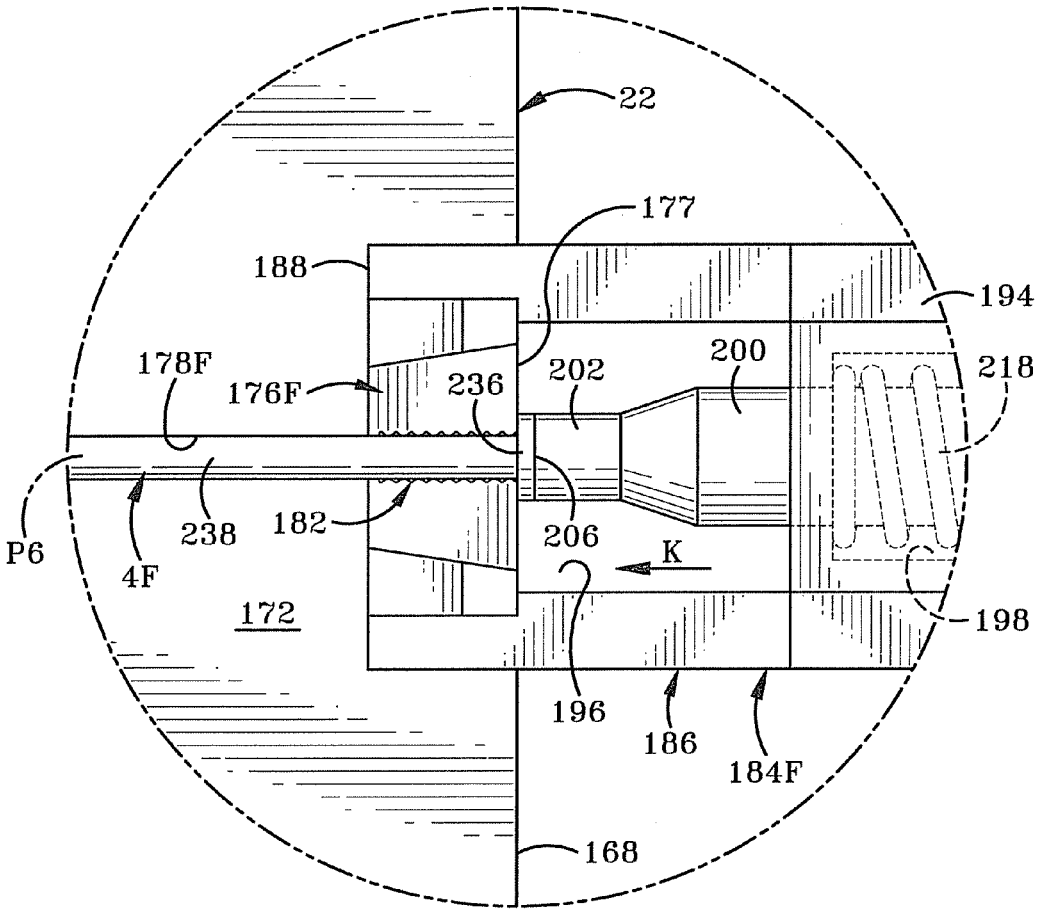
FIG. 15 is an enlarged view of the encircled portion of FIG. 14.
Figure 16:
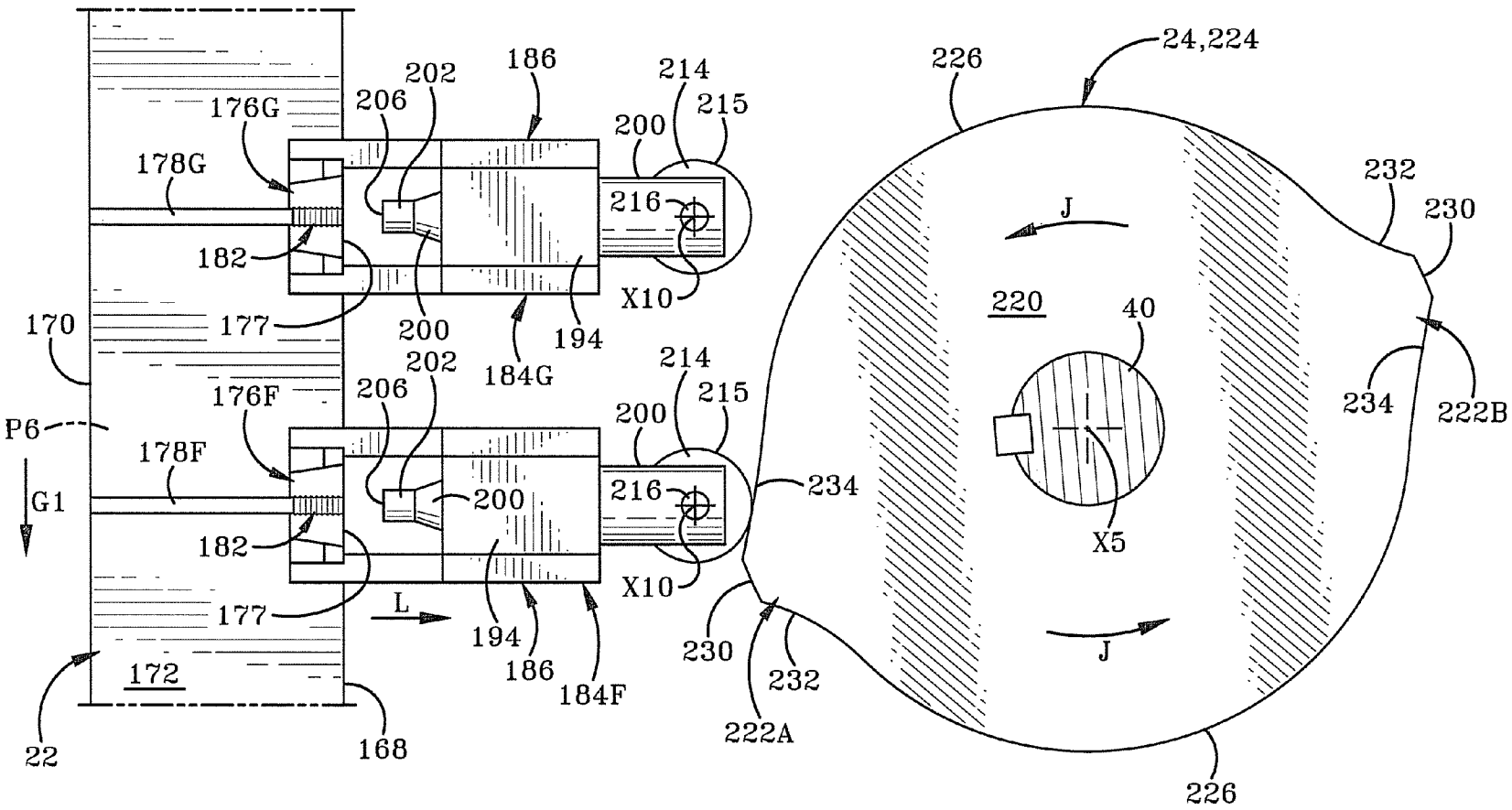
FIG. 16 is similar to FIGS. 13 and 14 and shows the cam lobe having rotated past the wheel or roller of the lower punching assembly to allow the punch which just formed the nail head to return from the punching position to the non-punching position.

The operation of the nail head formers 184 and cam 24 is now described with primary reference to FIGS. 13-16. FIG. 13 shows nail head former 184F and cam 24 just prior to the punching or nail head forming operation, while FIG. 14 illustrates these components at the moment of nail head forming. FIG. 16 shows these components just after the nail forming process and prior to the next nail head former 184G moving into position to form a nail head on a subsequent wire piece. Each of FIGS. 13, 14 and 16 shows the downward movement of the left most portion of carriage 22 at Arrow G1. These Figures also show the rotation of cam 24 about axis X5 at Arrows J. FIG. 13 shows groove 178F a short distance above and just prior to reaching position P6, which is at the same height as axis X5 and is directly behind axis X5, axle or shaft 40 (FIG. 1) and cam 24. At this stage, there are no wire pieces 2 or nails 4 within any of grooves 178 of carriage 22 although as illustrated in dashed lines in FIG. 14, the wire piece 2 which is to be formed into nail 4F is being carried magnetically within groove 152F and is engaged with jaw 150F of left carriage 20. FIG. 13 also shows that punch 200 of former 184F is in its non-punching position, as is punch 200 of former 184G (and all the other punches 200). FIG. 13 also illustrates that leading end 232 of cam 222A has moved into engagement with outer perimeter 215 of roller 214 without having effected any movement of punch 200 yet. Thus, the non-punching position shown in FIG. 13 is a fully retracted position with punching surface 206 at its maximum normal distance from the front compression or head forming surface 177 of jaw 176F (and surface 151 of jaw 150F shown in FIGS. 12 and 14).

FIG. 14 shows that drum 22 has continued rotation a short distance from the position shown in FIG. 13 so that groove 178F is aligned with position P6 and that the wire piece has reached position P6 to be formed into nail 4F. FIG. 14 shows punch 200 of former 184F at its fully extended punching position (and minimum distance to surfaces 177 and 151) and shows cam lobe 222A at its punch driving position with peak 230 engaging outer perimeter 215 of roller 214 of former 184F. FIG. 14 also shows that punch 200 of former 184G remains at its fully retracted non-punching position, which is true of all the other punches 200 of the nail head formers other than former 184F. The dashed lines in FIG. 14 also illustrate more particularly the location or position of wire piece 2 just prior to being formed into nail 4F. As previously noted, this nail piece is carried in groove 152F. More particularly, the head end 3 extends outwardly forward beyond front compression or head forming surface 151 of jaw 150F, front surface 142 of drum 20, front surface 177 of jaw 176F and front surface 168 of carriage 22. It is this portion or head end 3 which extends forward beyond surfaces 142, 151, 177 and 168 which is deformed by punch 200 in order to form therefrom a head 236 of nail 4F such that the remaining length of the wire piece serves as a shaft 238 of nail 4F wherein the shaft 238 retains the sharpened tip end 5. The position of the given nail piece 2 within a groove 152 so that the head end 3 extends outwardly beyond surfaces 142, 151, 177 and 168 is achieved earlier in the process when the wire piece 2 is transferred from carriage 18 to carriage 20 (FIG. 4). Thus, carriages 18 and 20 are positioned so that wire pieces 2 are transferred from grooves 114 of carriage 18 into grooves 152 with the wire pieces 2 extending through the open front ends of the respective grooves 152 and the respective head ends 3 extending forward of surfaces 142, 151, 177 and 168.

To effect the punching or nail head forming operation, the synchronized drive assembly rotates drums 20 and 22 and cam 24 at the proper synchronized rate so that peak 230 of lobe 222A engages outer perimeter 215 of wheel 214 when the given wire piece 2 reaches position P6, carried there within groove 152F into groove 178F. As carriages 20 and 22 and cam 24 rotate from the position shown in FIG. 13 to that shown in FIG. 14, the engagement of outer perimeter 224 of cam 24 with outer perimeter 215 of roller 214 causes roller 214 to rotate about its axis X10 while the leading end 232 of cam lobe 222A forces roller 214 and punch 200 linearly horizontally rearwardly (Arrow K) from the non-punching position to the punching position whereby punching surface 206 engages and deforms head end 3 of the wire piece 2 to form circular head 236 from head end 3. More particularly, forming surface 206 is forced against head end 3 toward surfaces 151 and 177 of the corresponding jaws to flatten malleable head end 3 against surfaces 151 and 177 into the circular head 236. This type of head punching thus produces a circular head 236 which is centered with respect to shaft 238 whereby head 236 and shaft 238 have respective circular outer perimeters that which are concentric about a central axis (represented at C1, C2 when at position P6) of shaft 238, as best shown in FIG. 12. At the moment of nail head formation at position P6, rollers 56 of assemblies 52 and 54 (FIG. 1) via their rolling engagement with outer perimeter 146 and 172 apply force respectively through carriages 20 and 22 toward position P6 and the wire piece 2 or nail 4 being formed to help ensure that the engaging surfaces 152 and 178 which hold the wire piece or nail are clamped tightly thereon, especially the clamping surfaces 156 and 182 of the corresponding jaws 150 and 176.

When the wire piece 2 has arrived at position P6 and is formed into nail 4F as shown in FIG. 14, the only one of grooves 178 of carriage 22 which has a wire piece and/or nail shaft disposed therein is groove 178F while the remaining grooves 178 are empty. In contrast, the other carriages 16, 18 and 20 carry a plurality of the parallel wire pieces within their respective grooves, and carriage 20 also carries a plurality of nails 4 in several of its grooves 152 with the shafts 238 thereof parallel to one another. Only one of nail head formers 184F is operated at a time and thus only one punch 200 of a given nail head former may be in the punching position (as shown in FIG. 14) at a time while the remaining punches are in the non-punching position. Thus, immediately before and immediately after the actuation of one of punches 200, all of punches 200 are in the non-punching position.

When cam 222A forces punch 200 to the punching position shown in FIGS. 14 and 15, spring 218 (FIG. 15) is compressed within passage 198. The continuing rotation of carriages 20 and 22 subsequent to the punching operation shown in FIG. 14 thus moves groove 178F, jaw 176F and nail head former 184F downwardly beyond position P6 and likewise moves the newly formed nail 4F, groove 152F, jaw 150F and the associated magnets 166 downwardly beyond position P6 generally to or toward the position of nail 4E, groove 152E, jaw 150E and the associated magnets 166 shown in FIG. 12. As the carriages 20 and 22 move from the position of FIG. 14 to the position of FIG. 16, outer perimeter 215 continues to rollingly engage outer perimeter 224 of cam 24 along peak 230 and trailing edge 234 as roller 214 rotates about axis X10. As outer perimeter 215 rolls off of peak 230 and along trailing edge 234, the compressed spring 218 (FIG. 15) expands to move punch 200 of former 184F forward linearly back to its non-punching position relative to housing 186 and carriage 22 as shown at Arrow L in FIG. 16. At this stage, all of grooves 178 are momentarily empty and all of punches 200 are momentarily in the non-punching position.

As the process continues, jaw 20 will deliver a subsequent wire piece 2A (FIG. 12) within groove 152G to position P6 as drum 22 moves groove 178G to position P6 simultaneously with groove 152G and also moves nail head former 184G so that its punch 200 is directly aligned in front of position P6 in order to form a head from the head end of wire piece 2A to create another nail. While the carriages 20 and 22 are moving in this synchronized fashion, cam 24 continues to rotate in synchronized fashion with carriages 20 and 22 to bring cam lobe 222B into contact with the outer perimeter 215 of roller 214 of former 184G in order to effect the punching operation in the same manner as previously described. Carriage 22 continues to rotate about axis X4 in order to sequentially move the jaws 176, grooves 178 and nail head formers 184 along their respective circular paths concentric about axis X4 to move sequentially past position P6, cam 24 and roller assembly 54. This synchronized sequential process continues repetitively whereby machine 1 forms wire pieces 2 into nails 4 at a relatively rapid pace.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A nail-forming apparatus comprising:

a first carriage;

a plurality of nail head formers mounted on the carriage; wherein the nail head formers comprise respective punches each movable between punching and non-punching positions; and a sequential wire piece positioner configured for sequentially positioning wire pieces respectively adjacent the nail head formers.

2. The apparatus of claim 1 wherein the first carriage is rotatable.

3. The apparatus of claim 2 wherein the nail head formers rotate with the first carriage along a first circular path.

4. The apparatus of claim 3 further comprising a second rotatable carriage; and a plurality of circumferentially spaced wire piece-engaging surfaces which rotate with the second carriage along a second circular path adjacent the first circular path.

5. The apparatus of claim 2 further comprising a plurality of circumferentially spaced wire piece-engaging surfaces which rotate with the first carriage;

wherein the nail head formers are respectively adjacent the wire piece-engaging surfaces.

6. The apparatus of claim 2 wherein the first carriage is rotatable about a first axis; and further comprising a plurality of grooves each of which is formed in the first carriage parallel to the first axis and is adapted to receive therein a wire piece.

7. The apparatus of claim 1 further comprising a second carriage; and a plurality of spaced magnets on the second carriage;

wherein the sequential wire piece positioner is configured for sequentially positioning the wire pieces respectively adjacent the magnets.

8. The apparatus of claim 1 further comprising a second carriage; and a plurality of spaced magnets on the second carriage;

wherein the sequential wire piece positioner is configured for sequentially positioning the magnets respectively adjacent the nail head formers.

9. The apparatus of claim 1 further comprising a plurality of grooves formed in the first carriage each adapted to receive therein a wire piece.

10. The apparatus of claim 1 further comprising a second carriage;

a plurality of spaced wire piece-engaging first surfaces on the first carriage;

a plurality of spaced wire piece-engaging second surfaces on the second carriage;

wherein the sequential wire piece positioner is configured for sequentially positioning the first surfaces respectively adjacent the second surfaces so that a given first surface and second surface when adjacent one another are adapted for clamping therebetween a wire piece.

11. The apparatus of claim 1 further comprising a second carriage; and a plurality of spaced wire piece-engaging first surfaces on the second carriage;

wherein the sequential wire piece positioner is configured for sequentially positioning the wire pieces respectively adjacent the first surfaces.

12. The apparatus of claim 11 further comprising a third carriage; and a plurality of spaced wire piece-engaging second surfaces on the third carriage;

wherein the sequential wire piece positioner is configured for sequentially positioning the wire pieces respectively adjacent the second surfaces.

13. The apparatus of claim 1 further comprising a second carriage; and a plurality of spaced wire piece-engaging first surfaces on the second carriage;

wherein the sequential wire piece positioner is configured for sequentially positioning the first surfaces respectively adjacent the nail head formers.

14. The apparatus of claim 1 further comprising a cam which drives movement of the punches from the non-punching positions to the punching positions.

15. A nail-forming apparatus comprising:

a first carriage; wherein the first carriage is rotatable about a first axis;

a plurality of nail head formers mounted on the carriage;

a sequential wire piece positioner configured for sequentially positioning wire pieces respectively adjacent the nail head formers;

an circular outer perimeter of the first carriage concentric about the first axis;

a head forming position adjacent the outer perimeter at which the nail head formers form heads on the wire pieces; and a rotatable roller having a circular outer perimeter which engages the outer perimeter of the first carriage at a location opposite the head forming position.

16. A nail-forming apparatus comprising:

a first carriage;

a plurality of nail head formers mounted on the carriage;

a sequential wire piece positioner configured for sequentially positioning wire pieces respectively adjacent the nail head formers;

a plurality of grooves formed in the first carriage each adapted to receive therein a wire piece;

a second carriage; and a plurality of spaced magnets on the second carriage;

wherein the sequential wire piece positioner is configured for sequentially positioning the magnets respectively adjacent the grooves.

17. A nail-forming apparatus comprising:

a first carriage;

a plurality of nail head formers mounted on the carriage;

a sequential wire piece positioner configured for sequentially positioning wire pieces respectively adjacent the nail head formers;

a second carriage;

a plurality of spaced wire piece-engaging first surfaces on the second carriage;

wherein the sequential wire piece positioner is configured for sequentially positioning the wire pieces respectively adjacent the first surfaces;

a third carriage;

a plurality of spaced wire piece-engaging second surfaces on the third carriage;

wherein the sequential wire piece positioner is configured for sequentially positioning the wire pieces respectively adjacent the second surfaces;

a fourth carriage; and a plurality of spaced wire piece-engaging third surfaces on the fourth carriage;

wherein the sequential wire piece positioner is configured for sequentially positioning the wire pieces respectively adjacent the third surfaces.

18. A nail-forming apparatus comprising:

a first carriage;

a plurality of nail head farmers which are mounted on the first carriage and which are adapted for deforming an end of a wire piece to form a nail head from the end of the wire piece; and a plurality of spaced magnets which are positionable respectively adjacent the nail head formers and which are adapted to magnetically carry respective wire pieces.

19. The apparatus of claim 18 wherein the nail head formers comprise respective punches each movable between punching and non-punching positions.

20. The apparatus of claim 19 further comprising a cam which drives movement of the punches from the non-punching positions to the punching positions.

* * * * *

UNITED STATES PATENT AND TRADEMARK OFFICE

CERTIFICATE OF CORRECTION

PATENT NO. : 8,998,733 B2
APPLICATION NO. : 13/092246
DATED : April 7, 2015
INVENTOR(S) : Chi Hyun Kim It is certified that error appears in the above-identified patent and that said Letters Patent is hereby corrected as shown below:

In the Claims

Column 24, line 45 (Claim 18) “farmers” should be changed to --formers--.

Signed and Sealed this
Twenty-eighth Day of July, 2015

Michelle K. Lee

Michelle K. Lee
*Director of the United States Patent and Trademark Office*